US011026528B2

(12) United States Patent
Goldberg et al.

(10) Patent No.: US 11,026,528 B2
(45) Date of Patent: Jun. 8, 2021

(54) 3D DISPOSABLE SERVING UTENSILS CREATED BY FOLDING AND BENDING 2D BENDABLE MATERIALS AND BOXES INCORPORATING DISPOSABLE SERVING UTENSILS

(71) Applicants: Brett Goldberg, Burlingame, CA (US); Theo Stewart-Stand, Brooklyn, NY (US); Frank Ling, Brooklyn, NY (US); Bruce W. Hamby, Montgomery, TX (US)

(72) Inventors: Brett Goldberg, Burlingame, CA (US); Theo Stewart-Stand, Brooklyn, NY (US); Frank Ling, Brooklyn, NY (US); Bruce W. Hamby, Montgomery, TX (US)

(73) Assignee: Brett I Goldberg, Burlingame, CA (US)

( * ) Notice: Subject to any disclaimer, the term of this patent is extended or adjusted under 35 U.S.C. 154(b) by 0 days.

(21) Appl. No.: 16/632,276

(22) PCT Filed: Jul. 26, 2018

(86) PCT No.: PCT/US2018/043926
§ 371 (c)(1),
(2) Date: Jan. 17, 2020

(87) PCT Pub. No.: WO2019/023474
PCT Pub. Date: Jan. 31, 2019

(65) Prior Publication Data

US 2020/0367680 A1 Nov. 26, 2020

Related U.S. Application Data

(60) Provisional application No. 62/537,932, filed on Jul. 27, 2017, provisional application No. 62/797,086,
(Continued)

(51) Int. Cl.
*A47G 21/04* (2006.01)
*B65D 51/24* (2006.01)
(Continued)

(52) U.S. Cl.
CPC ..... *A47G 21/04* (2013.01); *A47G 21/001* (2013.01); *A47G 21/02* (2013.01); *A47G 21/045* (2013.01);
(Continued)

(58) Field of Classification Search
CPC ..... A47G 21/04; A47G 21/001; A47G 21/02; A47G 21/045; B65D 5/42; B65D 51/246; B65D 77/245; B65D 81/36
(Continued)

(56) References Cited

U.S. PATENT DOCUMENTS 1,324,682 A 12/1919 McIntyre
1,625,335 A 4/1927 Schneider
(Continued)

FOREIGN PATENT DOCUMENTS

EP 3178748 A1 5/2017
FR 9 409 367 7/1994
FR 3 017 371 A3 8/2015

OTHER PUBLICATIONS

Office Action dated Jun. 28, 2019 in U.S. Appl. No. 16/046,571.

*Primary Examiner* — Christopher R Demeree
(74) *Attorney, Agent, or Firm* — Hamby Law Firm; Bruce W. Hamby

(57) ABSTRACT

Disposable three dimensional serving utensils that can be incorporated into a pizza box, a cake box or other container, via incised and scored blanks, from which disposable utensils, such as spatulas and knives, can be formed.

6 Claims, 19 Drawing Sheets

Related U.S. Application Data filed on Jan. 25, 2019, provisional application No. 62/862,131, filed on Jun. 16, 2019.

(51) Int. Cl.

| | |
|---|---|
| ***B65D 5/42*** | (2006.01) |
| ***B65D 81/36*** | (2006.01) |
| ***B65D 77/24*** | (2006.01) |
| ***A47G 21/00*** | (2006.01) |
| ***A47G 21/02*** | (2006.01) |
| ***A47G 21/08*** | (2006.01) |

(52) U.S. Cl.

CPC ..... *A47G 21/08* (2013.01); *B65D 5/42* (2013.01); *B65D 51/246* (2013.01); *B65D 77/245* (2013.01); *B65D 81/36* (2013.01); *A47G 2021/002* (2013.01); *A47G 2400/061* (2013.01); *B65D 2585/366* (2013.01)

(58) Field of Classification Search

USPC ..... 229/125.03, 906, 103; 426/115; 206/551, 45.2, 45.21, 45.23, 45.26; 220/212

See application file for complete search history.

(56) References Cited

U.S. PATENT DOCUMENTS

| | | | | |
|---|---|---|---|---|
| 1,633,605 | A | 6/1927 | Mitchell | |
| 4,798,323 | A * | 1/1989 | Platt | B65D 5/2028 229/115 |
| 5,110,038 | A * | 5/1992 | Pantisano | B65D 5/6626 206/551 |
| 5,476,214 | A | 12/1995 | Fisk, Jr. | |
| 6,299,918 | B1 * | 10/2001 | Morgese | A47G 21/001 206/551 |
| 6,905,065 | B2 | 6/2005 | Holden | |
| 6,966,483 | B2 | 11/2005 | Manninen | |
| 7,004,377 | B2 * | 2/2006 | Metcalf | A47G 21/001 229/101.1 |
| 9,498,074 | B1 | 11/2016 | Baryshyan | |
| 10,131,492 | B2 | 11/2018 | Rubino | |
| 2003/0201316 | A1 * | 10/2003 | Manninen | B65D 5/2028 229/103 |
| 2003/0209592 | A1 | 11/2003 | Holden | |
| 2006/0191983 | A1 | 8/2006 | Cargile | |
| 2006/0226206 | A1 | 10/2006 | Reap | |
| 2017/0158410 | A1 | 6/2017 | Rubino | |
| 2018/0317736 | A1 * | 11/2018 | Goldberg | A47L 13/52 |

* cited by examiner

3D DISPOSABLE SERVING UTENSILS CREATED BY FOLDING AND BENDING 2D BENDABLE MATERIALS AND BOXES INCORPORATING DISPOSABLE SERVING UTENSILS

CLAIM OF PRIORITY

This application claims priority to and the benefit of U.S. Provisional Patent Application No. 62/537,932, filed Jul. 27, 2017.

TECHNICAL FIELD

This application discloses novel 3D serving utensils which can be created out of boxes and containers.

The disclosed embodiments and the methods associated therewith have applicability to any area of food service. They are also applicable to any situation where it would be convenient, desirable or cost effective to dispose of the serving utensils after serving food.

BACKGROUND ART

The desire to incorporate useful utensils into boxes used to serve pizza and other types of food has resulted in the patenting of a number of devices.

In French patent 9,409,367, Hamon taught a spatula tab that adjoined a tray or pot and an alternative in which the spatula was contained in a sheath formed by the lid of a film coating. Hamon taught that his spatula tab could be attached to and used in conjunction with trays or pots of honey, butter, jam, spread, cheese, ice cream, cold cuts, confectionery, pharmaceutical and craft products.

Rubino, EP 3,178,748 A1, taught a pizza box whose lid contains a parabolic-shaped break line from which a small tray can be torn in order to hold a slice of pizza so that the slice can be eaten without the need for using a fork and knife.

Holden, U.S. Pat. No. 6,905,065 B2, taught a box with a sectional lid that can be torn apart to hold slices of pizza.

Fisk, Jr., U.S. Pat. No. 5,476,214, taught a pizza box top having a number of spatula-type trapezoidal shaped plates with sharp points that could be separated from the box and then used to lift out individual slices of pizza and to cut through the cheese in the center of the pizza.

However, these references do not teach the embodiments disclosed in this application and particularly, do not teach the construction of utensils that gain strength and rigidity when folded and formed in the manner disclosed and claimed by this application.

SUMMARY OF INVENTION

Technical Problem

How to economically create serving utensils that are focused on the ability to cut a pizza or other food product, that have sufficient strength and rigidity to be used, that can be easily and inexpensively incorporated into the packaging of the pizza or other food product, that can be disposed of when soiled and that can be easily stored in a space efficient manner until they are needed.

Solution to Problem

Create, incise and score a blank of material, such as cardboard, which is rigid enough to create forms of spatulas and cutting instruments, all of which are either disposable or reusable as desired, and which can be incorporated into a box, container or other item according to the disclosed apparatuses and methods.

Advantageous Effects of the Disclosed Embodiments

One advantage of the disclosed embodiments is the ability to fabricate at will a spatula, as well as a pizza or food cutting tool, all from a pizza box or other container, in which these utensils can be stored flat until needed, thereby both eliminating the need to have such utensils available independent of the pizza or food purchase and minimizing the amount of space necessary to store such utensils.

A further advantage of the disclosed embodiments is the ability to fabricate a spatula and a cutting surface that gains strength and rigidity when folded and formed as disclosed in this application.

A further advantage of the disclosed embodiments is the ability to fabricate a spatula and a cutting surface that have handles that are oriented approximately vertically so that they fit in the human hand better than utensils that are oriented in approximately the same plane as the pizza or other food product to be sliced, served or cut.

A further advantage of the disclosed embodiments is the ability to keep a spatula and a cutting utensil together with the pizza or food product so that the spatula or cutting utensil does not become separated and lost or mislaid prior to when needed.

Yet a further advantage of the disclosed embodiments is the ability after assembling the spatula and the cutting utensil to either keep them for future use, if desired, or to dispose of them in an environmentally friendly manner after a single use if they have been used.

Still another advantage is the ability to incorporate a spatula, as well as a cutting tool into a pizza box (or other container or item) which serves yet another purpose and from which the blank can be removed if and when needed, thereby adding utility to the box (or other container or item) in the form of a useful set of tools that can be easily fabricated on demand and used for serving the pizza or other food product.

DESCRIPTION OF THE EMBODIMENTS

Although the embodiments disclosed in the figures use cardboard, any bendable material could be used that can be incised, scored and folded and whose stiffness is approximately equivalent to or greater than that of cardboard, including, but not limited to corrugated fiberboard, paper, nylon, plastic, foil, aluminum or other metals, paperboard, wood veneer, palm fronds, leaves, compostable paperboard or other composite material without departing from the disclosures contained in and claimed by this application.

This application discloses 14 embodiments of blanks that can be used to create disposable serving utensils that can be incorporated into pizza boxes or other food packaging. Additionally this application discloses exemplary embodiments showing how the embodiments of the disposable serving utensils disclosed can be incorporated into boxes, containers or other items.

Each of the disclosed and claimed embodiments may be used to serve and cut food. In this regard, it is to be understood that the word food is used in its broadest possible meaning and includes foods of all types.

First Exemplary Embodiment

Figure 1:
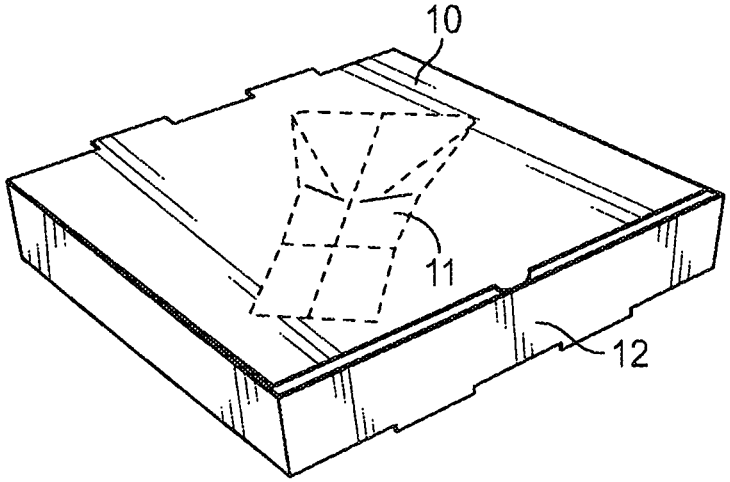
FIG. 1 is a top left front perspective of an embodiment, in one form, of a pizza box lid and blank that can be used to form a blunt embodiment of a disposable serving utensil.
Figure 6:
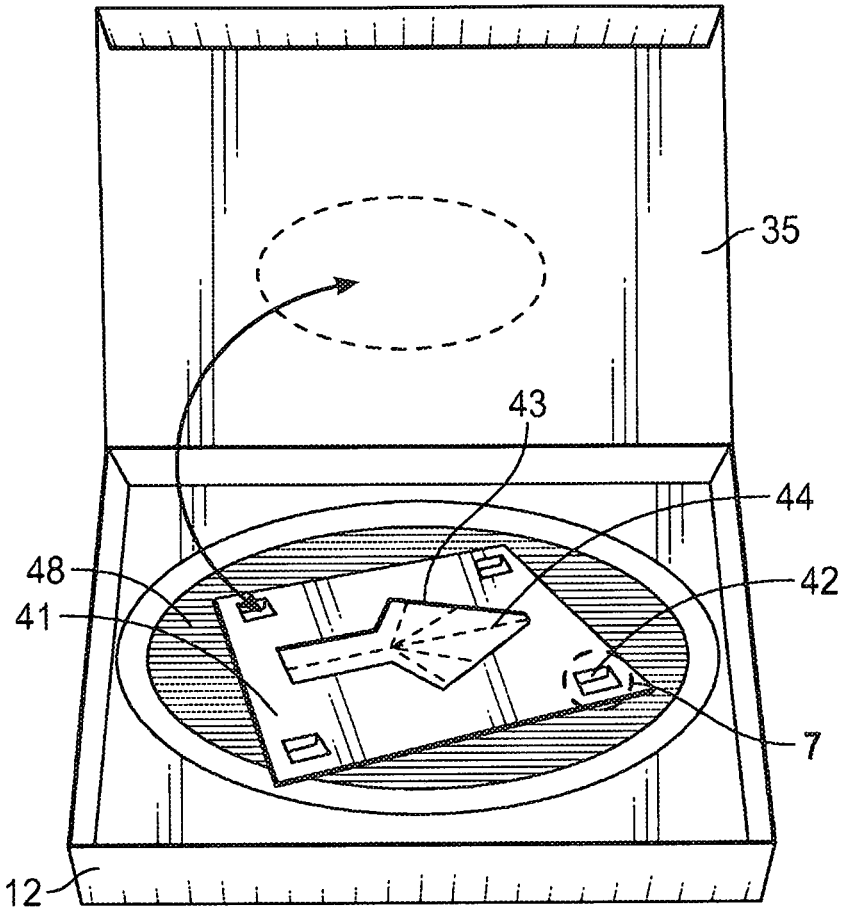
FIG. 6 is a top front perspective of an embodiment, in one form, of a foldable and bendable pattern for creating a serving utensil that can be punched out of an incised sheet of bendable material that is configured to also be used as a support for the lid of product packaging that consists of a sheet of bendable material.
Figure 11:
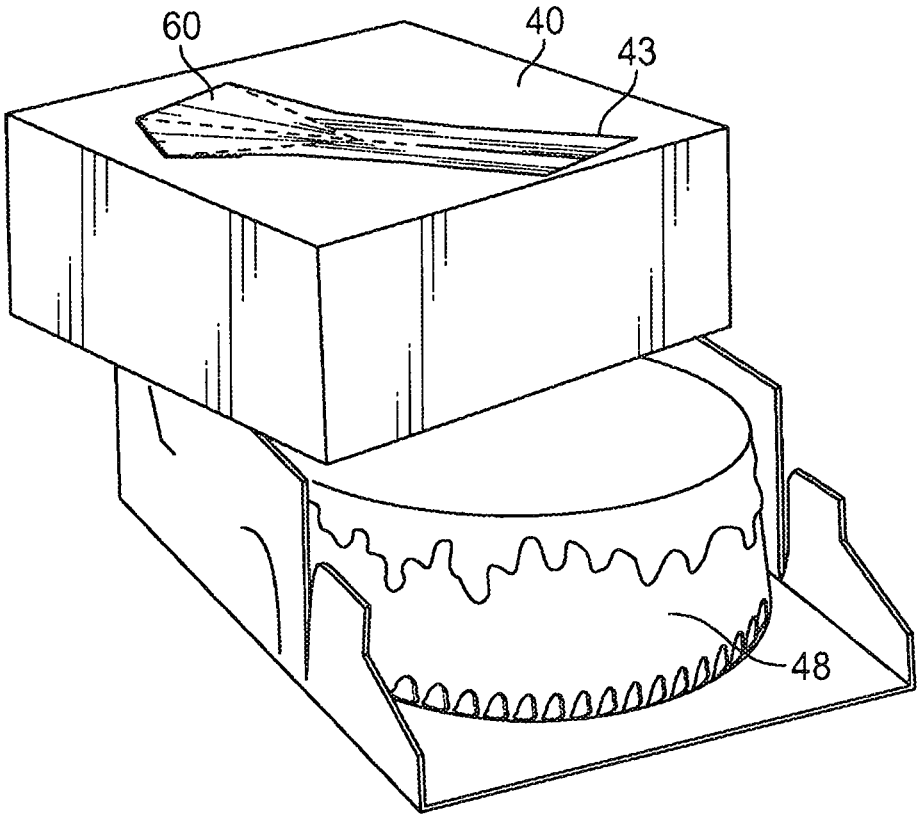
FIG. 11 is a top left front perspective of an embodiment, in one form, of a foldable and bendable pattern for creating a non-blunt semi-serrated embodiment of a serving utensil that can be punched out of an incised sheet of bendable material that comprises product packaging.
Figure 43:
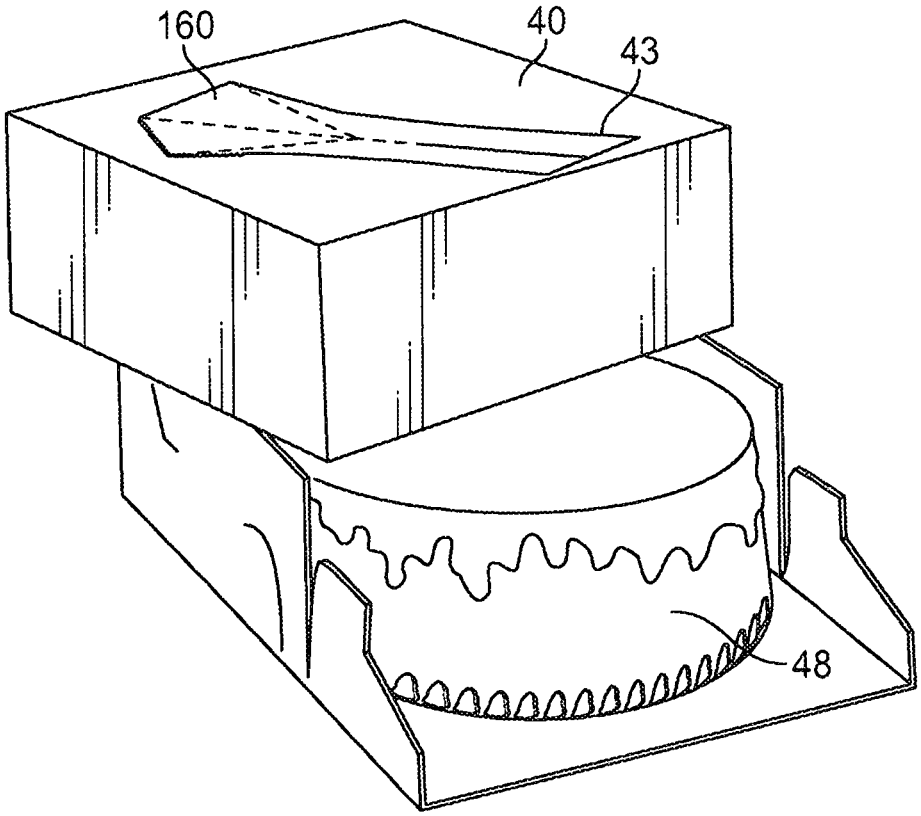
FIG. 43 is a top left front perspective of an embodiment, in one form, of a foldable and bendable pattern for creating a squeeze-only non-blunt semi-serrated embodiment of a serving utensil that can be punched out of an incised sheet of bendable material that comprises product packaging.

FIG. 1 illustrates an embodiment, in one form, of a foldable and bendable pattern for creating a disposable serving utensil that can be punched out of an incised sheet of bendable material that comprises product packaging. FIG. 1 depicts a blunt embodiment (11) of a disposable serving utensil in packaging which is a pizza delivery box, that contains a pizza box lid and blank (10) and box front (12). However, other forms of packaging could also be used without departing from the disclosure as claimed, including, but not limited to, a cake box lid [container lid and blank, (40)] as shown in FIGS. 11 and 43 and a sheet of bendable material that is configured to also be used as a support for a product packaging lid as shown in FIG. 6 [lid support and blank, (41)].

Figure 2:
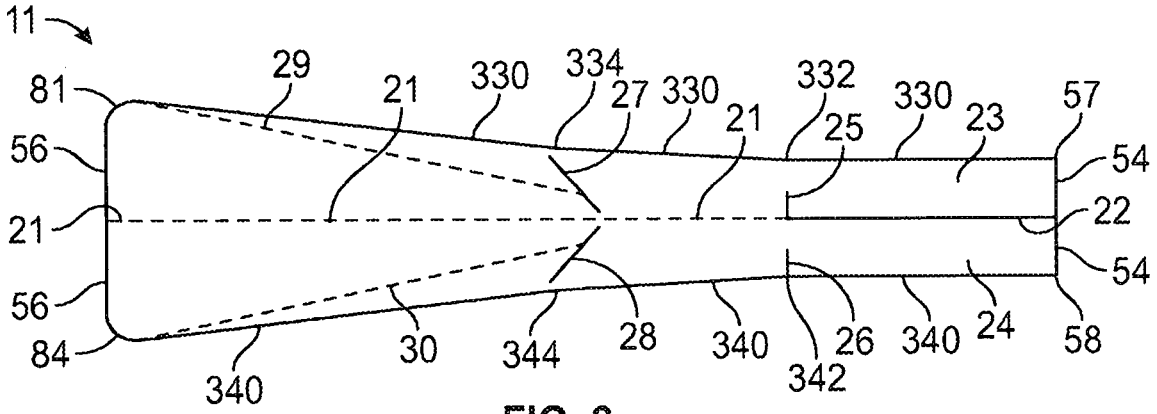
FIG. 2 is a top plan of an embodiment, in one form, of a flat blank that can be used to form a blunt embodiment of a disposable serving utensil.

FIG. 2 shows an embodiment, in one form, of a flat blank that can be used to form a blunt embodiment of a disposable serving utensil (11). The blunt embodiment of a disposable serving utensil disclosed in FIG. 2 is comprised of an incised center crease line (21) that is designed to make it easy for the flexible bendable material of which the flat blank is composed to crease; a center handle cut (22) which is cut through the flexible bendable material of which the flat blank is composed; a right folding handle (23); a left folding handle (24); a right handle cut (25); a left handle cut (26); a right handle angling cut (27); a left handle angling cut (28); a right incised flex line (29); and a left incised flex line (30).

The First Exemplary Embodiment depicted in FIG. 2 further shows one short end (54) bounded by a right corner (57) and a left corner (58); a longer end (56) that is approximately parallel to the short end and that is bounded by a right side dull point (81) and a left side dull point (84); a right side (330) bounded by the right corner (57) and the right side dull point (81) and which is divided into three approximately straight segments by a right side first inflection point (332) and a right side second inflection point (334); and a left side (340) that is approximately the mirror image of the right side and which is bounded by the left corner (58) and the left side dull point (84) and which is divided into three approximately straight segments by a left side first inflection point (342) and a left side second inflection point (344).

Figure 3:
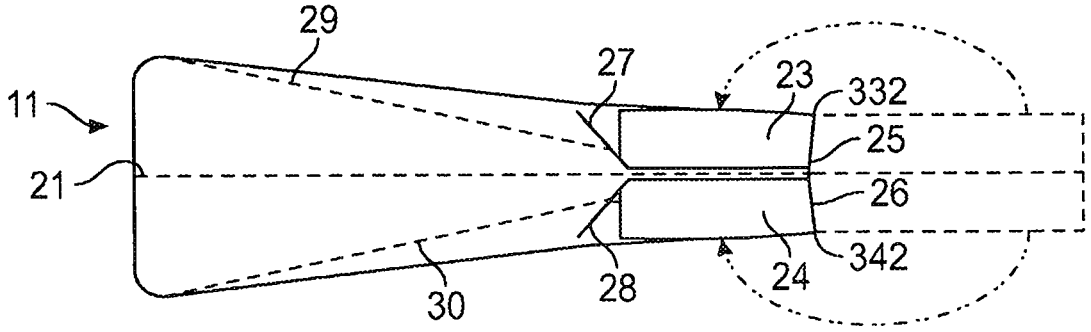
FIG. 3 is a top plan of an embodiment, in one form, of a flat blank in the process of being formed into a blunt embodiment of a disposable serving utensil.

FIG. 3 depicts the first step in readying the blunt embodiment of a disposable serving utensil (11). That Figure shows that the right folding handle (23) is folded over the right handle cut (25) and the left folding handle (24) is folded over the left handle cut (26). The right side first inflection point (332) is illustrated as being equally far from the short end [(54) in FIG. 2] as the right handle cut (25) and the left side first inflection point (342) is illustrated as being equally far from the short end [(54) in FIG. 2] as the left handle cut (26).

Figure 4:
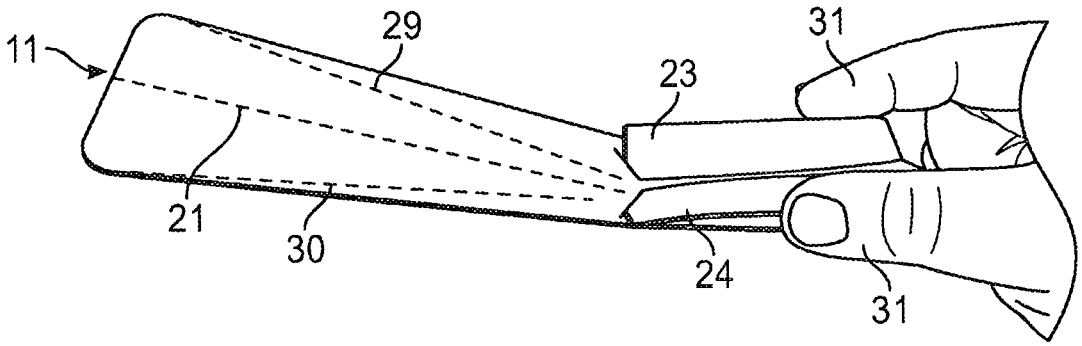
FIG. 4 is a left top perspective view of an embodiment, in one form, of a flat blank in the process of being formed into a blunt embodiment of a disposable serving utensil.
Figure 5:
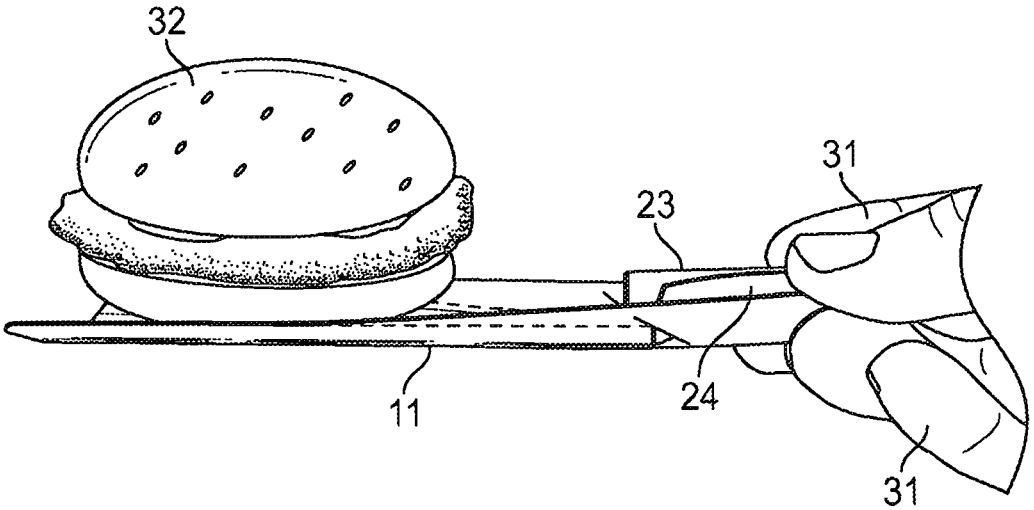
FIG. 5 is a left elevational view of an embodiment, in one form, of a blunt embodiment of a disposable serving utensil being used to serve a portion of food.

FIG. 4 depicts the user's fingers (31) pressing together the right folding handle (23) and the left folding handle (24) and the end of the right folding handle fitting into the right handle angling cut (27) and the end of the left folding handle (24) fitting into the left handle angling cut (28) so that the blunt embodiment of a disposable serving utensil (11) will remain in the shape in which it has been placed. The assembled blunt embodiment of a disposable serving utensil may then be used to slide underneath a portion of food (32) to be served and to serve that portion as desired, as shown by FIG. 5. The blunt embodiment of a disposable serving utensil may optionally be disposed of after use or may be kept for later additional uses if desired.

Second Exemplary Embodiment

FIG. 6 illustrates another embodiment, in one form, of a foldable and bendable pattern for creating a disposable serving utensil that can be punched out of an incised sheet of bendable material that comprises product packaging. FIG. 6 depicts a pie-shaped embodiment (44) of a serving utensil that is embedded in a lid support and blank (41). An incised punch out line (43) allows the pie-shaped embodiment to be punched out of the lid support and blank without tearing the flexible and bendable material from which the lid support and blank is formed. FIG. 6 shows a box lid with viewing portal (35) that allows visualization of the pie-shaped embodiment from outside of the box. FIG. 6 further shows that the lid support and blank contains a plurality of support pylons (42) that protrude downward into a food item (48), which is shown as a pizza in this Figure. The purpose of the support pylons is to prevent the lid support and blank from collapsing onto the food item.

Figure 7:
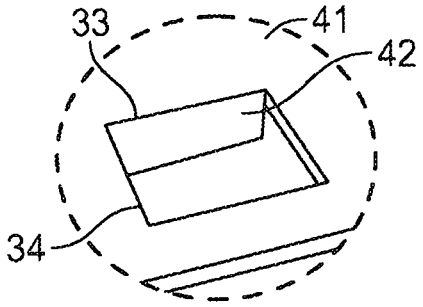
FIG. 7 is a top left front perspective of an embodiment, in one form, of a lid support pylon.
Figure 8:
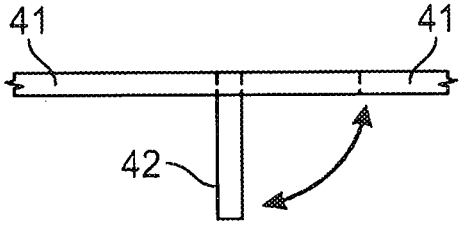
FIG. 8 is a left elevational view of an embodiment, in one form, of a lid support pylon and a method for creating the lid support pylon.

FIG. 7 is a call out show detail of a support pylon (42). FIG. 7 discloses that the support pylon is formed by punching out the support pylon along the cut lines for support pylon (34). FIG. 8 shows a side cut-away perspective of the support pylon (42).

Figure 9:
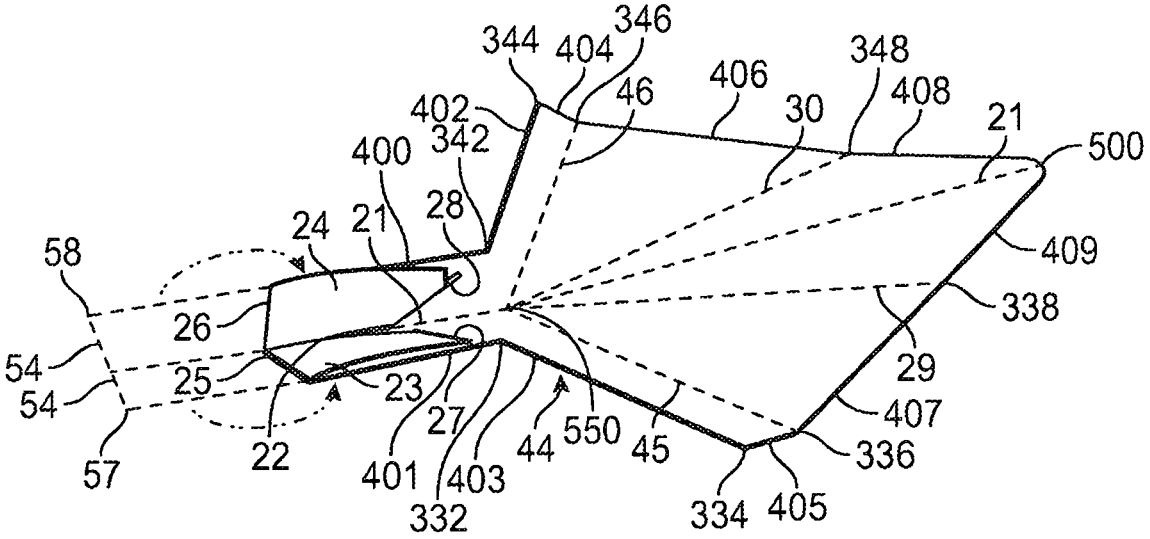
FIG. 9 is an upper right rear perspective of an embodiment, in one form, of a pattern for creating a pie-shaped embodiment and an illustration of the process of forming a pie-shaped embodiment.
Figure 10:
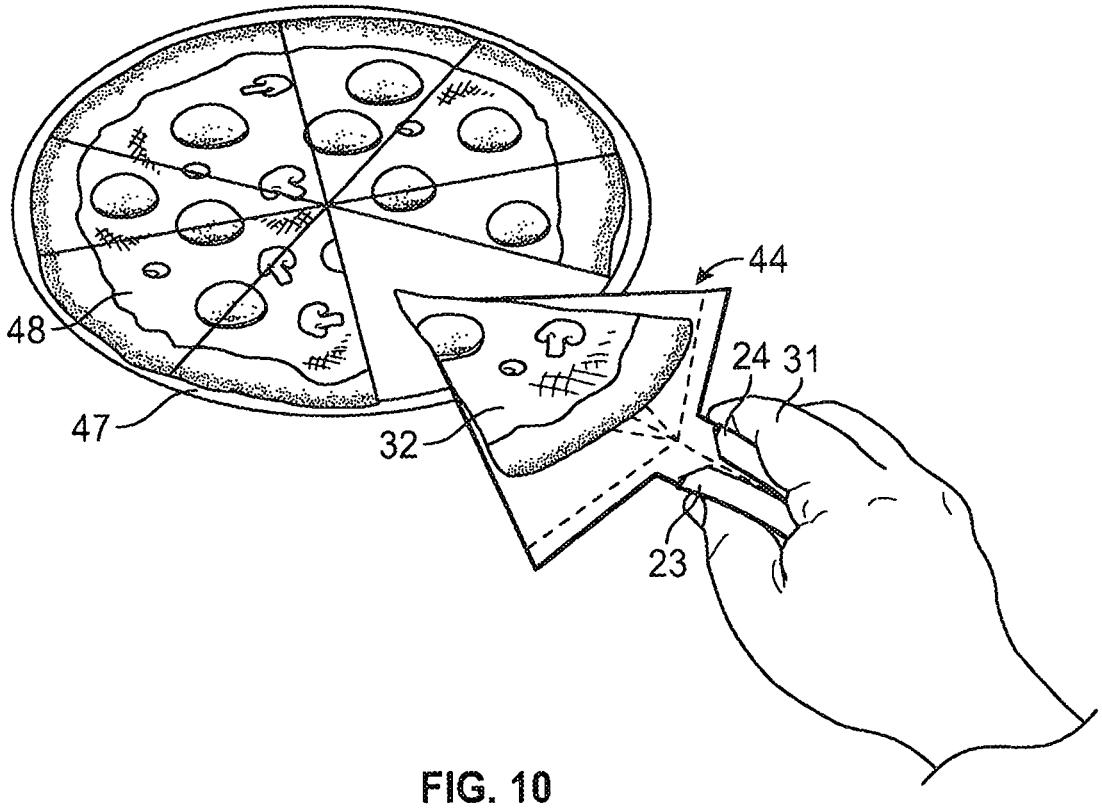
FIG. 10 is a top left perspective of an embodiment, in one form, of a pie-shaped embodiment being used to serve a portion of food.

FIG. 9 shows the pattern to make the pie-shaped embodiment (44) of a disposable serving utensil that can be punched out of an incised sheet of foldable and bendable material that comprises product packaging. This embodiment is partially comprised of an incised center crease line (21) that extends from the short end (54) to the leading point of the utensil (500); a right folding handle (23); a left folding handle (24); a right handle cut (25); a left handle cut (26); a right handle angling cut (27); a left handle angling cut (28); a right incised flex line (29); a left incised flex line (30); a right embankment (45); and a left embankment (46). The right folding handle and the left folding handle fold in the direction indicated by the arrows in FIG. 9, with the right folding handle folding across the right handle cut (25) and the left folding handle folding across the left handle cut (26). The right folding handle (23) tucks into the right handle angling cut (27), and the left folding handle (24) tucks into the left handle angling cut (28). FIG. 10 shows that once this has been done, the user's fingers (31) are used to squeeze the right folding handle (23) and the left folding handle (24) upward and together to form the pie-shaped embodiment (44), which can then be used to pick up a portion to be served (32) of a food item (48) from off of an underlying surface (47).

FIG. 9 further illustrates that the pie-shaped embodiment (44) partially comprises a short end (54) that extends from a right corner (57) to a left corner (58); a left side comprising a left side of the handle (400) that extends from the left corner (58) to a left side first inflection point (342), a left rear piece (402) that extends from the left side first inflection point (342) to the left side second inflection point (344), a left incline (404) that extends from the left side second inflection point (344) to the left side third inflection point (346), a left side trailing edge (406) that extends from the left side third inflection point (346) to a left side fourth inflection point (348), and a left side leading edge (408) that extends from the left side fourth inflection point (348) to a leading point of the utensil (500); and a right side that is approximately the mirror image of the left side, said right side comprising a right side of the handle (401) that extends from the right corner (57) to a right side first inflection point (332), a right rear piece (403) that extends from the right side first inflection point (332) to the right side second inflection point (334), a right incline (405) that extends from the right side second inflection point (334) to the right side third inflection point (336), a right side trailing edge (407) that extends from the right side third inflection point (336) to a right side fourth inflection point (338), a right side leading edge (409) that extends from the right side fourth inflection point (338) to a leading point of the utensil (500), a center handle cut (22) that extends from the short end to a right handle cut (25) and a central focus point (550) where right incised flex line (29), the left incised flex line (30), the right embankment (45), and the left embankment (46) all intersect with the incised center crease line (21).

Third Exemplary Embodiment

FIG. 11 illustrates still another embodiment, in one form, of a foldable and bendable pattern for creating a disposable serving utensil that can be punched out of an incised sheet of bendable material that comprises product packaging. FIG. 11 depicts a non-blunt semi-serrated embodiment (60) circumscribed by an incised punch out line (43) in a container lid and blank (40) in a box that contains a food item (48), shown as a cake in FIG. 11. The incised punch out line (43) allows the non-blunt semi-serrated embodiment (60) to be punched out of the lid support and blank (40) without tearing the flexible and bendable material from which the lid support and blank is formed.

Figure 12:
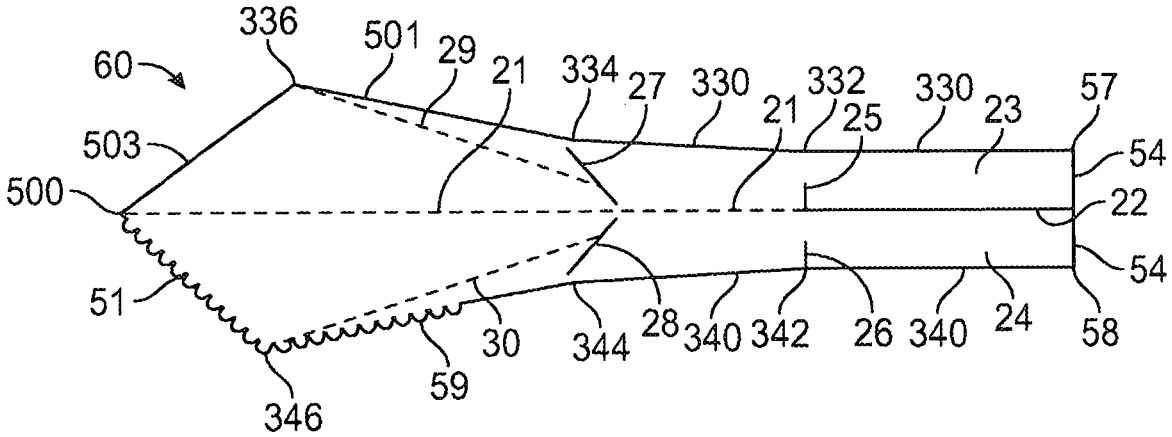
FIG. 12 is a top plan of an embodiment, in one form, of a foldable and bendable pattern for creating a non-blunt semi-serrated embodiment of a serving utensil after the pattern has been punched out of an incised sheet of bendable material that comprises product packaging.

FIG. 12 shows the pattern to make the non-blunt semi-serrated embodiment (60). This embodiment is partially comprised of an incised center crease line (21); a center handle cut (22); a right folding handle (23); a left folding handle (24); a right handle cut (25); a left handle cut (26); a right handle angling cut (27); a left handle angling cut (28); a right incised flex line (29); a left incised flex line (30); a leading serrated edge (51); a right leading non-serrated edge (503).

The embodiment illustrated in FIG. 12 is further comprised of one short end (54) that extends from a right corner (57) to a left corner (58); a left side (340) that extends from the left corner (58) to a left side second inflection point (344) and which is approximately bisected by a left side first inflection point (342); a trailing serrated edge (59) that extends from the left side second inflection point (344) to a left side third inflection point (346); a leading serrated edge (51) that extends from the left side third inflection point (346) to a leading point of the utensil (500); a right side (330) that extends from the right corner (57) to a right side second inflection point (334) and which is approximately bisected by a right side first inflection point (332); a right trailing non-serrated edge (501) that extends from the right side second inflection point (334) to a right side third inflection point (336); and a right leading non-serrated edge (503) that extends from the right side third inflection point (336) to the leading point of the utensil (500).

Figure 13:
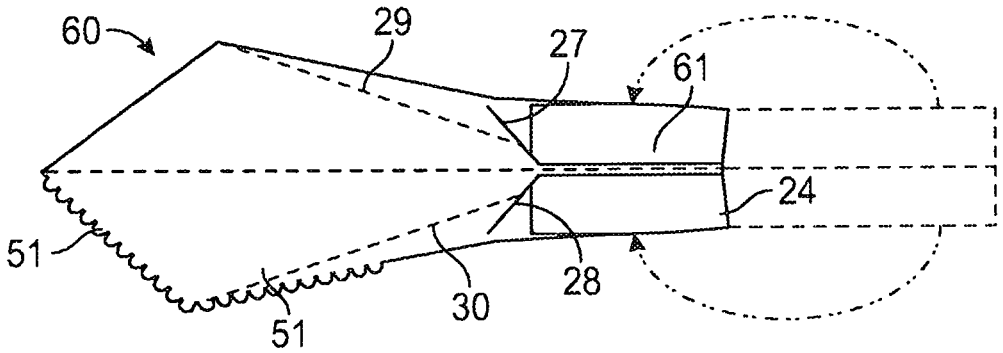
FIG. 13 is a top plan of an embodiment, in one form, of a foldable and bendable pattern for creating a non-blunt semi-serrated embodiment of a serving utensil that is in the process of being formed into a non-blunt semi-serrated embodiment.
Figure 14:
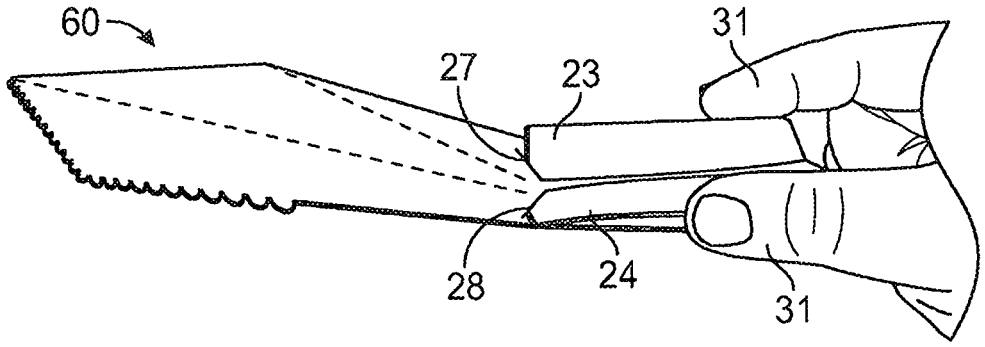
FIG. 14 is a left top perspective view of an embodiment, in one form, of a foldable and bendable pattern for creating a non-blunt semi-serrated embodiment of a serving utensil in the process of being formed into a non-blunt semi-serrated embodiment of a disposable serving utensil.

The right folding handle and the left folding handle fold in the direction indicated by the arrows in FIG. 13, with the right folding handle folding across the right handle cut (27) and the left folding handle folding across the left handle cut (28). The right folding handle (23) tucks into the right handle angling cut (27) and the left folding handle (24) tucks into the left handle angling cut (28). FIG. 14 shows that once this has been done, the user's fingers (31) are used to squeeze the right folding handle (23) and the left folding handle (24) upward and together to form the non-blunt semi-serrated embodiment (60). The non-blunt semi-serrated embodiment can then be used to pick up a portion of food (32) to be served, as in FIG. 15 where the food item is shown as a piece of cake.

Fourth Exemplary Embodiment

Figure 16:
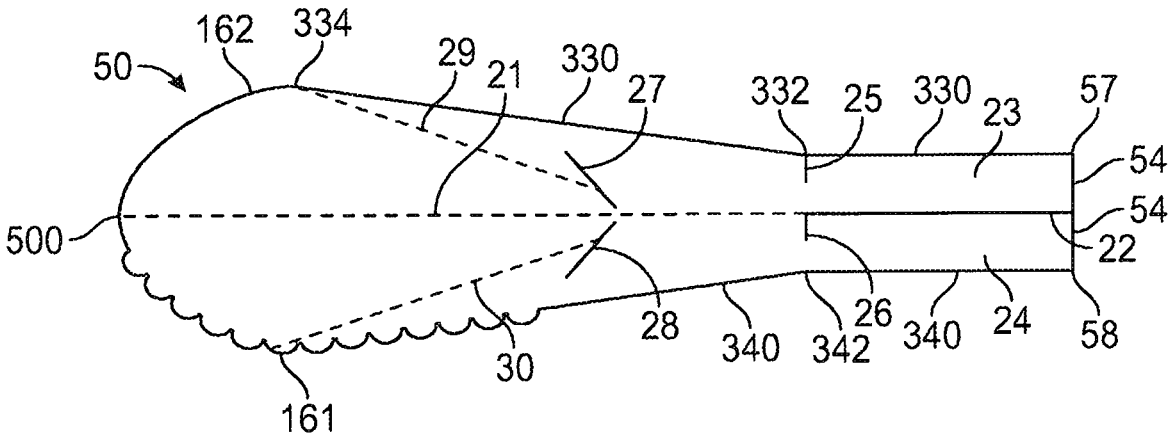
FIG. 16 is a top plan of an embodiment, in one form, of a foldable and bendable pattern for creating a semi-serrated embodiment of a serving utensil.

FIG. 16 illustrates still another embodiment, in one form, of a foldable and bendable pattern for creating a disposable serving utensil that can be punched out of an incised sheet of bendable material that comprises product packaging. FIG. 16 depicts a semi-serrated embodiment (50) and shows the pattern to make the semi-serrated embodiment. The semi-serrated embodiment is partially comprised of an incised center crease line (21), a center handle cut (22), a right folding handle (23), a left folding handle (24), a right handle cut (25), a left handle cut (26), a right handle angling cut (27), a left handle angling cut (28), a right incised flex line (29), a left incised flex line (30), a curved serrated edge suitable for cutting (161) and a curved non-serrated edge (162). The purpose of all incised lines is to create lines where the foldable, bendable material from which the pattern is created will bend.

FIG. 16 further illustrates that the semi-serrated embodiment (50) is further comprised of a short end (54) that extends from a right corner (57) to a left corner (58); a left side (340) that extends from the left corner (58) through a left side first inflection point (342) to a curved serrated edge (161); the curved serrated edge (161) extends from the left side (340) to a leading point of the utensil (500); a right side (330) that extends from the right corner (57) through a right side first inflection point (332) to a right side second inflection point (334); and a curved non-serrated edge (162) that extends from the right side second inflection point (334) to the leading point of the utensil (500).

Figure 15:
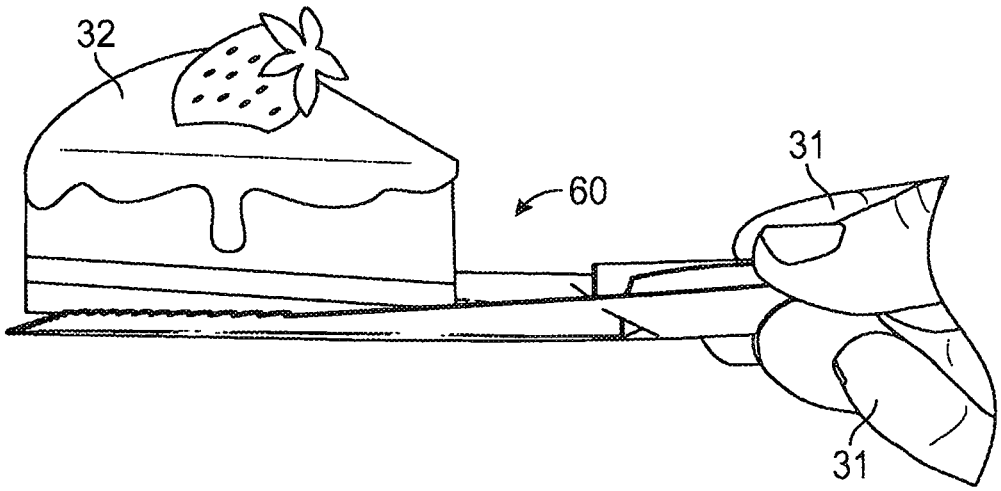
FIG. 15 is a left elevational view of an embodiment, in one form, of a non-blunt semi-serrated embodiment of a disposable serving utensil being used to serve a portion of food.
Figure 17:
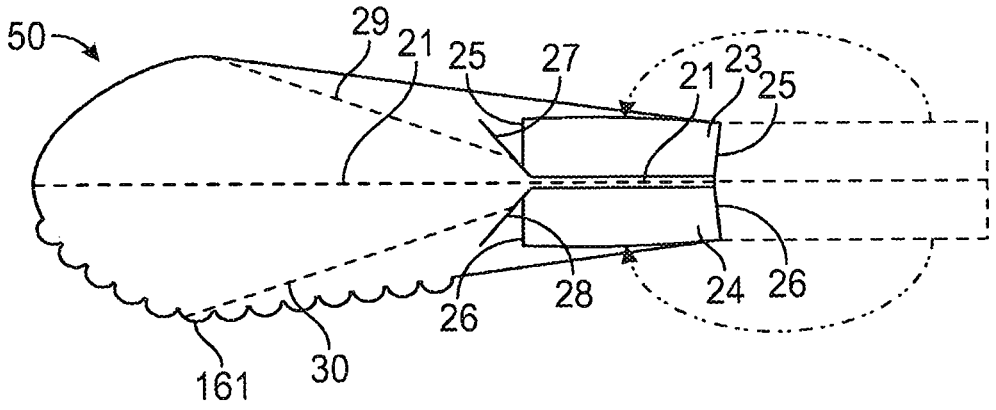
FIG. 17 is a top plan of an embodiment, in one form, of a foldable and bendable pattern for creating a semi-serrated embodiment of a serving utensil that is in the process of being formed into a semi-serrated embodiment.
Figure 18:
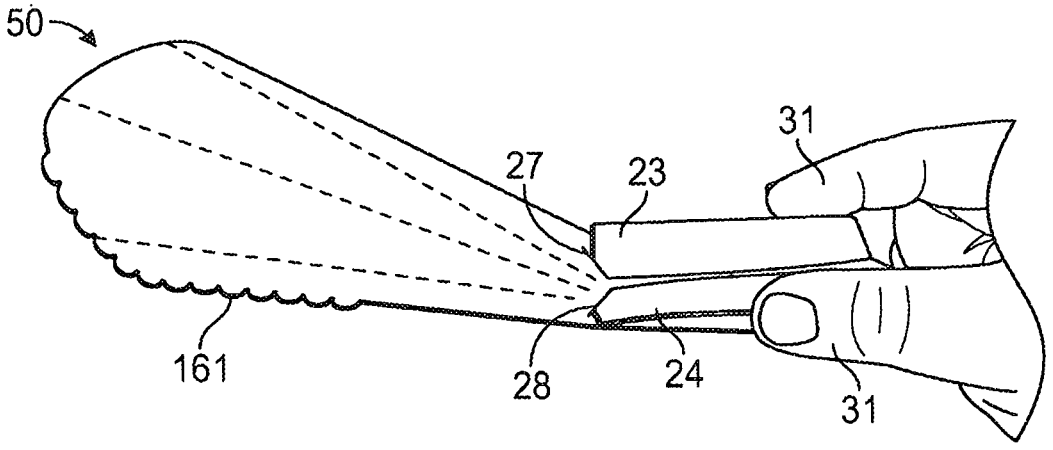
FIG. 18 is a left top perspective view of an embodiment, in one form, of a foldable and bendable pattern for creating a semi-serrated embodiment of a serving utensil in the process of being formed into a semi-serrated embodiment of a disposable serving utensil.
Figure 19:
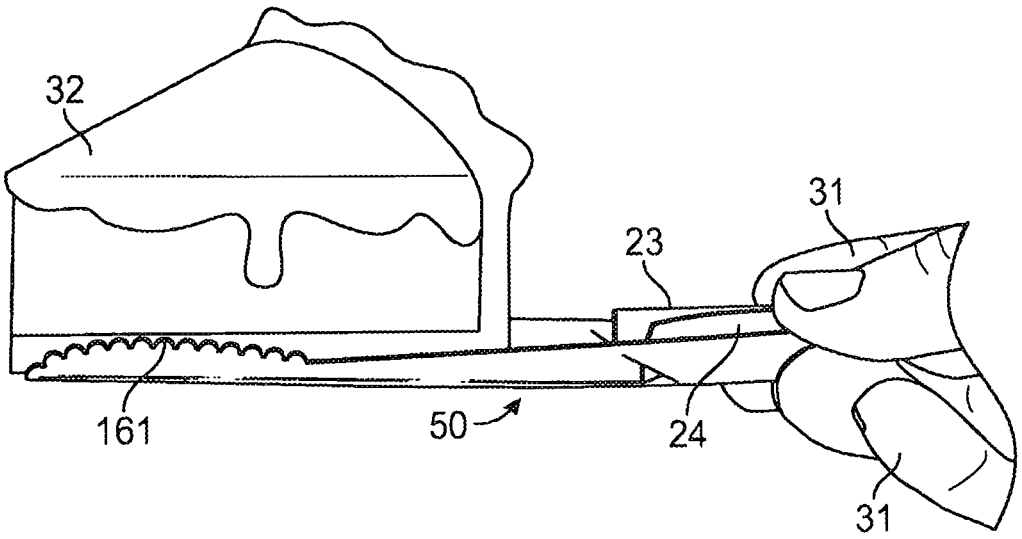
FIG. 19 is a left elevational view of an embodiment, in one form, of a semi-serrated embodiment of a disposable serving utensil being used to serve a portion of food.

The right folding handle and the left folding handle fold in the direction indicated by the arrows in FIG. 17, with the right folding handle (23) folding across the right handle cut (25) and the left folding handle (24) folding across the left handle cut (26). The right folding handle (23), tucks into the right handle angling cut (27) and the left folding handle (24) tucks into the left handle angling cut (28). FIG. 18 shows that once this has been done, the user's fingers (31) are used to squeeze the right folding handle (23) and the left folding handle (24) upward and together to form the semi-serrated embodiment (50). The semi-serrated embodiment can then be used to pick up a portion of food (32) to be served as shown in FIG. 15, where the food item is shown as a piece of pie.

Fifth Exemplary Embodiment

Figure 20:
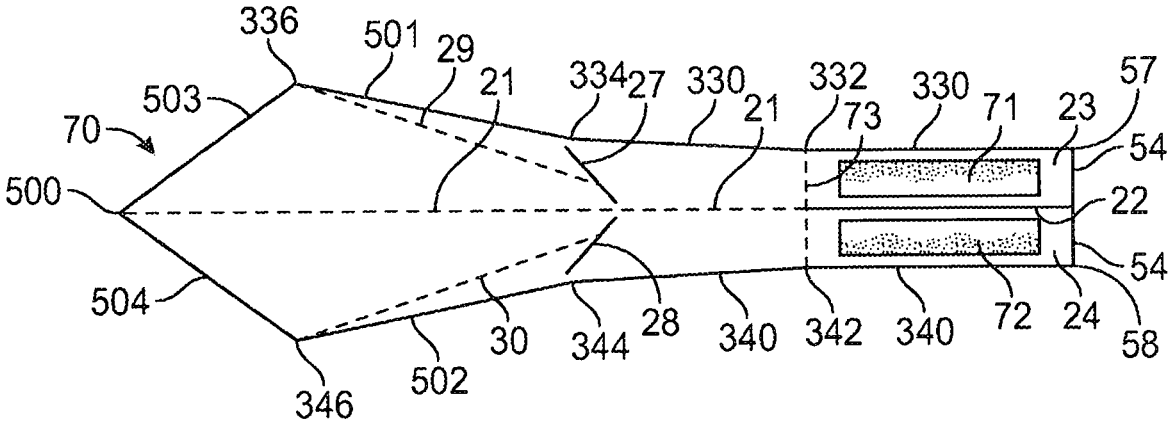
FIG. 20 is a top plan of an embodiment, in one form, of a foldable and bendable pattern for creating a pointed non-serrated embodiment of a serving utensil.

FIG. 20 illustrates still another embodiment, in one form, of a foldable and bendable pattern for creating a disposable serving utensil that can be punched out of an incised sheet of bendable material that comprises product packaging. FIG. 20 depicts a pointed non-serrated embodiment, (70) and shows the pattern to make the pointed non-serrated embodiment. The pointed non-serrated embodiment is partially comprised of an incised center crease line (21), a center handle cut (22), a right folding handle (23) that contains a right handle adhesive (71), a left folding handle (24) that contains a left handle adhesive (72), an incised handle fold line (73), a right handle angling cut (27), a left handle angling cut (28), a right incised flex line (29), and a left incised flex line (30). The left handle adhesive and the right handle adhesive are preferably located on both sides of each handle.

The Fifth Exemplary Embodiment disclosed in FIG. 20 is further partially comprised of a short end (54) that extends from a right corner (57) to a left corner (58); a left side (340) that extends from the left corner (58) through a left side first inflection point (342) to a left side second inflection point (344); a left trailing non-serrated edge (502) that extends from the left side second inflection point (344) to a left side third inflection point (346); a left leading non-serrated edge (504) that extends from the left side third inflection point (346) to a leading point of the utensil (500); a right side (330) that extends from the right corner (57) through a right side first inflection point (332) to a right side second inflection point (334); a right trailing non-serrated edge (501) that extends from the right side second inflection point (334) to a right side third inflection point (336); and a right leading non-serrated edge (503) that extends from the right side third inflection point (336) to a leading point of the utensil (500).

Figure 21:
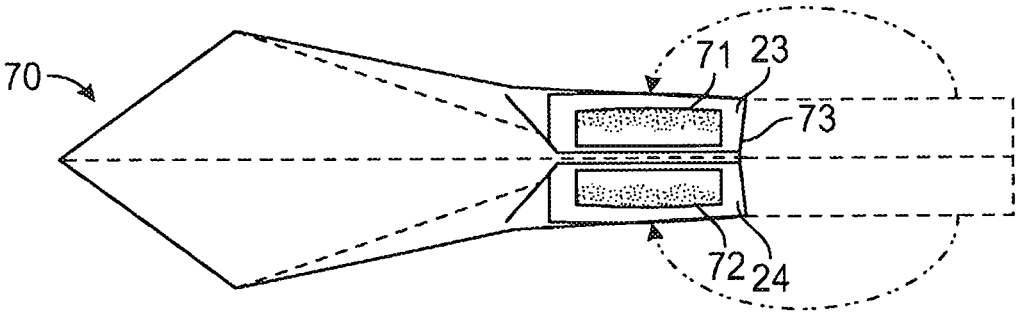
FIG. 21 is a top plan of an embodiment, in one form, of a foldable and bendable pattern for creating a pointed non-serrated embodiment of a serving utensil that is in the process of being formed into a pointed non-serrated embodiment.
Figure 22:
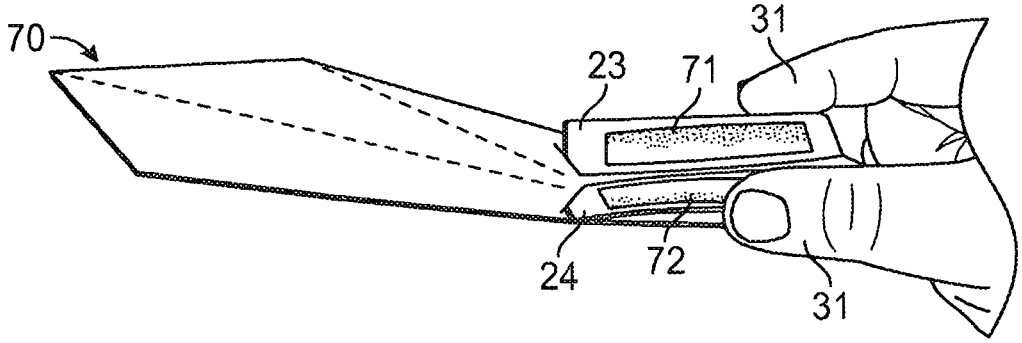
FIG. 22 is a left top perspective view of an embodiment, in one form, of a foldable and bendable pattern for creating a pointed non-serrated embodiment of a serving utensil in the process of being formed into a pointed non-serrated embodiment of a disposable serving utensil.
Figure 23:
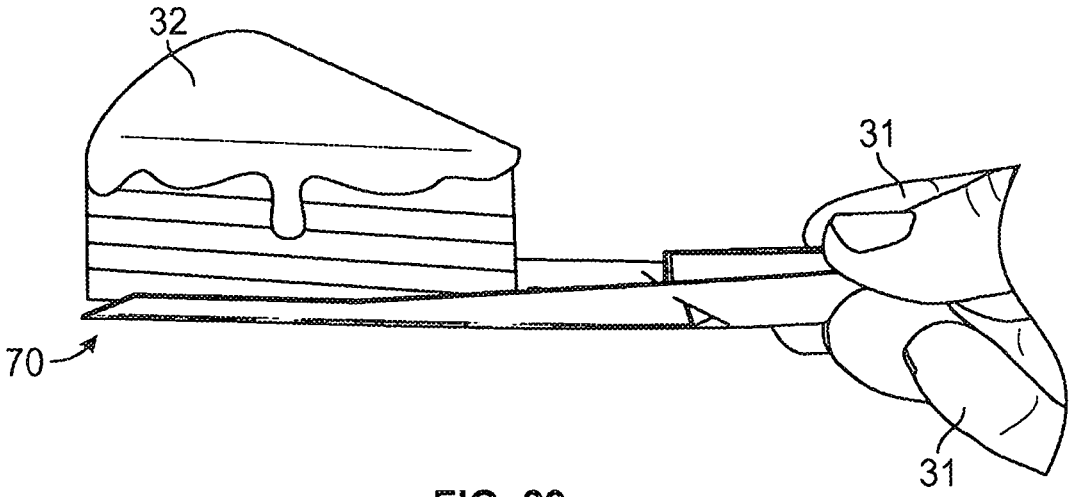
FIG. 23 is a left elevational view of an embodiment, in one form, of a pointed non-serrated embodiment of a disposable serving utensil being used to serve a portion of food.

The right folding handle (23) and the left folding handle (24) fold in the direction indicated by the arrows in FIG. 21, with the right folding handle folding across the incised handle fold line (73) and the adhesive on each handle causing the handles to stick as folded. The right folding handle (23) tucks into the right handle angling cut (27) and the left folding handle (24) tucks into the left handle angling cut (28). FIG. 22 shows that once this has been done, the user's fingers (31) are used to squeeze the right folding handle (23) and the left folding handle (24) upward and together to form the pointed non-serrated embodiment (70); the right handle adhesive (71) and the left handle adhesive (72) causes the right folding handle (23) to stick to the left folding handle (24). The pointed non-serrated embodiment (70) can then be used to pick up a portion of food (32) to be served, as shown in FIG. 23 where the food item is depicted as a piece of cake.

Sixth Exemplary Embodiment

Figure 24:
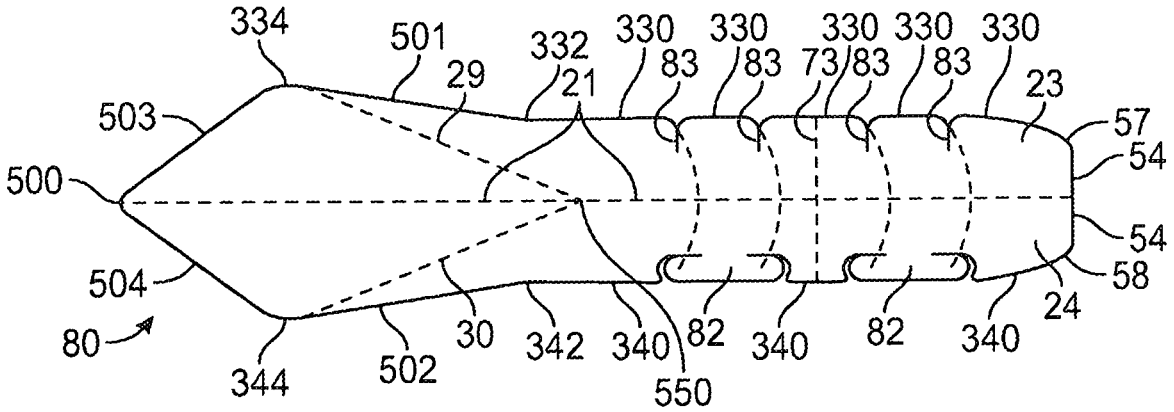
FIG. 24 is a top plan of an embodiment, in one form, of a foldable and bendable pattern for creating a dull pointed non-serrated embodiment of a serving utensil.

FIG. 24 illustrates still another embodiment, in one form, of a foldable and bendable pattern for creating a disposable serving utensil that can be punched out of an incised sheet of bendable material that comprises product packaging. FIG. 24 depicts a dull pointed non-serrated embodiment (80) and shows the pattern to make the dull pointed non-serrated embodiment. The dull pointed non-serrated embodiment is partially comprised of an incised center crease line (21), a right folding handle (23), a left folding handle (24), a right incised flex line (29) extending from a central focus point (500) to a right side second inflection point (334), a left incised flex line (30) extending from a central focus point (500) to a left side second inflection point (344), an incised handle fold line (73), a plurality of exterior tabs (82), and a plurality of tab slots (83).

The Sixth Exemplary Embodiment illustrated in FIG. 24 is further partially comprised of a short end (54) that extends from a right corner (57) to a left corner (58); a left side (340) that extends from the left corner (58) to an exterior tab (82), through and between a plurality of exterior tabs to a left side first inflection point (342); a left trailing non-serrated edge (502) that extends from the left side first inflection point (342) to a left side second inflection point (344); a left leading non-serrated edge (504) that extends from the left side second inflection point (344) to a leading point of the utensil (500); a right side (330) that extends from the right corner (57) to a tab slot (83), through and between a plurality of tab slots to a right side first inflection point (332); a right trailing non-serrated edge (501) that extends from the right side first inflection point (332) to a right side second inflection point (334); and a right leading non-serrated edge (503) that extends from the right side second inflection point (334) to the leading point of the utensil (500).

Figure 25:
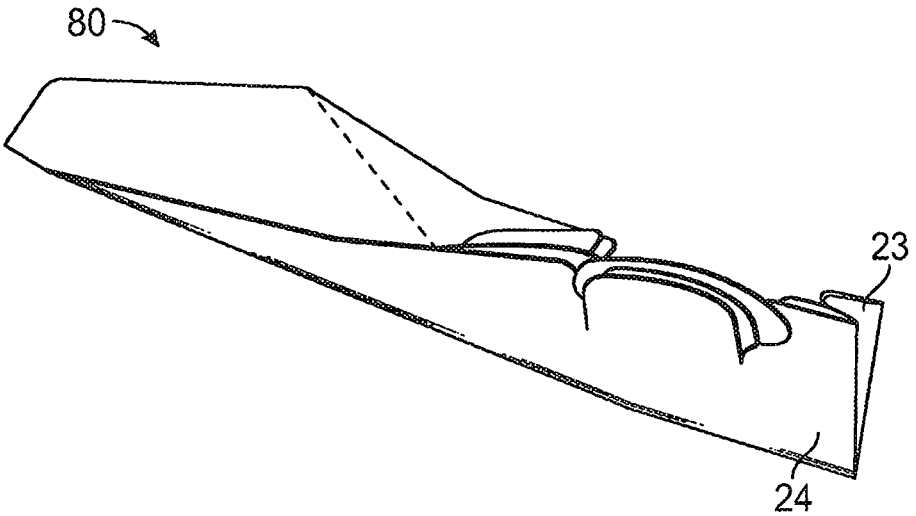
FIG. 25 is a top left rear perspective of an embodiment, in one form, of a dull pointed non-serrated embodiment of a serving utensil.
Figure 26:
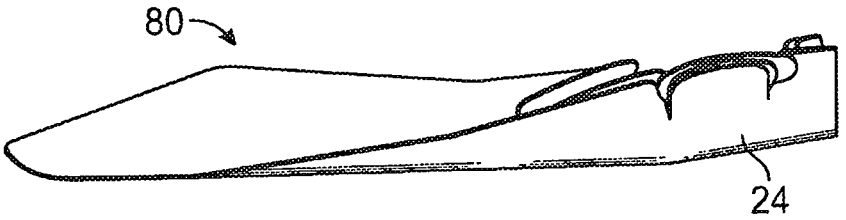
FIG. 26 is a left elevational view of an embodiment, in one form, of a dull pointed non-serrated embodiment of a serving utensil.

FIG. 24 shows that the dull pointed non-serrated embodiment (80) is formed by squeezing together the right folding handle (23) and left folding handle (24) and then passing the exterior tabs (82) into the tab slots (83) to affix the folding of the embodiment. The resulting utensil is depicted from an upper left perspective in FIG. 25 and from a left elevational view in FIG. 26.

Seventh Exemplary Embodiment

Figure 27:
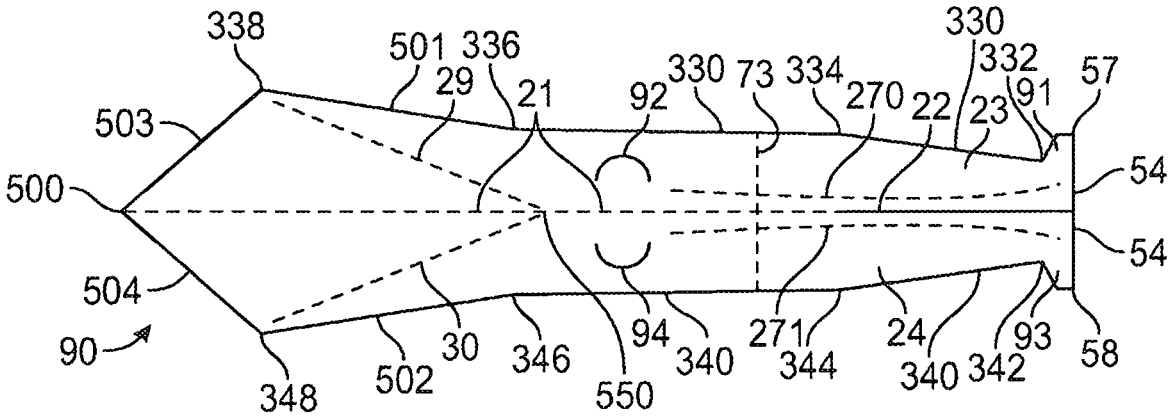
FIG. 27 is a top plan of an embodiment, in one form, of a foldable and bendable pattern for creating a second pointed non-serrated embodiment of a serving utensil.

FIG. 27 illustrates still another embodiment, in one form, of a foldable and bendable pattern for creating a disposable serving utensil that can be punched out of an incised sheet of bendable material that comprises product packaging. FIG. 27 depicts a second pointed non-serrated embodiment (90) and shows the pattern to make the second pointed non-serrated embodiment. The second pointed non-serrated embodiment (90) is partially comprised of an incised center crease line (21), a center handle cut (22), a right folding handle (23), a left folding handle (24), a right incised flex line (29), a left incised flex line (30), a central focus point (550), an incised handle fold line (73), a right tab (91), a right interior insertion slot (92), a left tab (93), a left interior insertion slot (94), an incised right handle flex line (270) and an incised left handle flex line (271).

The Seventh Exemplary Embodiment illustrated in FIG. 27 is further partially comprised of a short end (54) that extends from a right corner (57) to a left corner (58); a left tab (93) that extends from the left corner (58) to a left side first inflection point (342); a left side (340) that extends from the left side first inflection point (342) through a left side second inflection point (344) to a left side third inflection point (346); a left trailing non-serrated edge (502) that extends from the left side third inflection point (346) to a left side fourth inflection point (348); a left leading non-serrated edge (504) that extends from the left side fourth inflection point (348) to a leading point of the utensil (500); a right tab (91) that extends from the right corner (57) to a right side first inflection point (332); a right side (330) that extends from the right side first inflection point (332) through a right side second inflection point (334) to a right side third inflection point (336); a right trailing non-serrated edge (501) that extends from the right side third inflection point (336) to a right side fourth inflection point (338); a right leading non-serrated edge (503) that extends from the right side fourth inflection point (338) to the leading point of the utensil (500).

Figure 28:
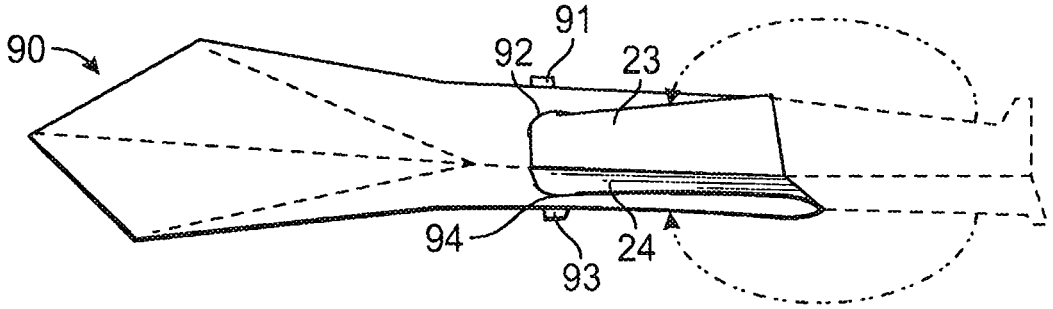
FIG. 28 is a top left perspective of an embodiment, in one form, of a foldable and bendable pattern for creating a second pointed non-serrated embodiment of a serving utensil and the process of creating a second pointed non-serrated embodiment.
Figure 29:
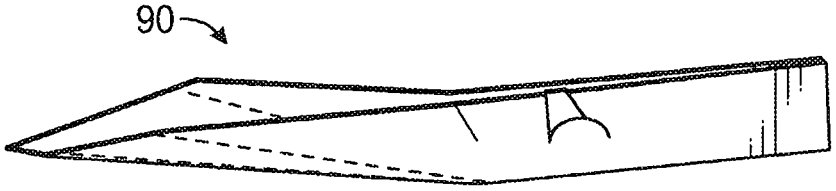
FIG. 29 is a left elevational view of an embodiment, in one form, of a second pointed non-serrated embodiment of a serving utensil.

FIG. 28 shows that the second pointed non-serrated embodiment (90) is created by folding the right folding handle (23) and left folding handle (24) across the incised handle fold line (73) and then slightly squeezing together the right folding handle (23) and left folding handle (24) so that the right tab (91) can be fitted through the right interior insertion slot (92) and the left tab (93) can be fitted through the left interior insertion slot (94). FIG. 29 depicts a left elevation of the formed second pointed non-serrated embodiment (90).

Eighth Exemplary Embodiment

Figure 30:
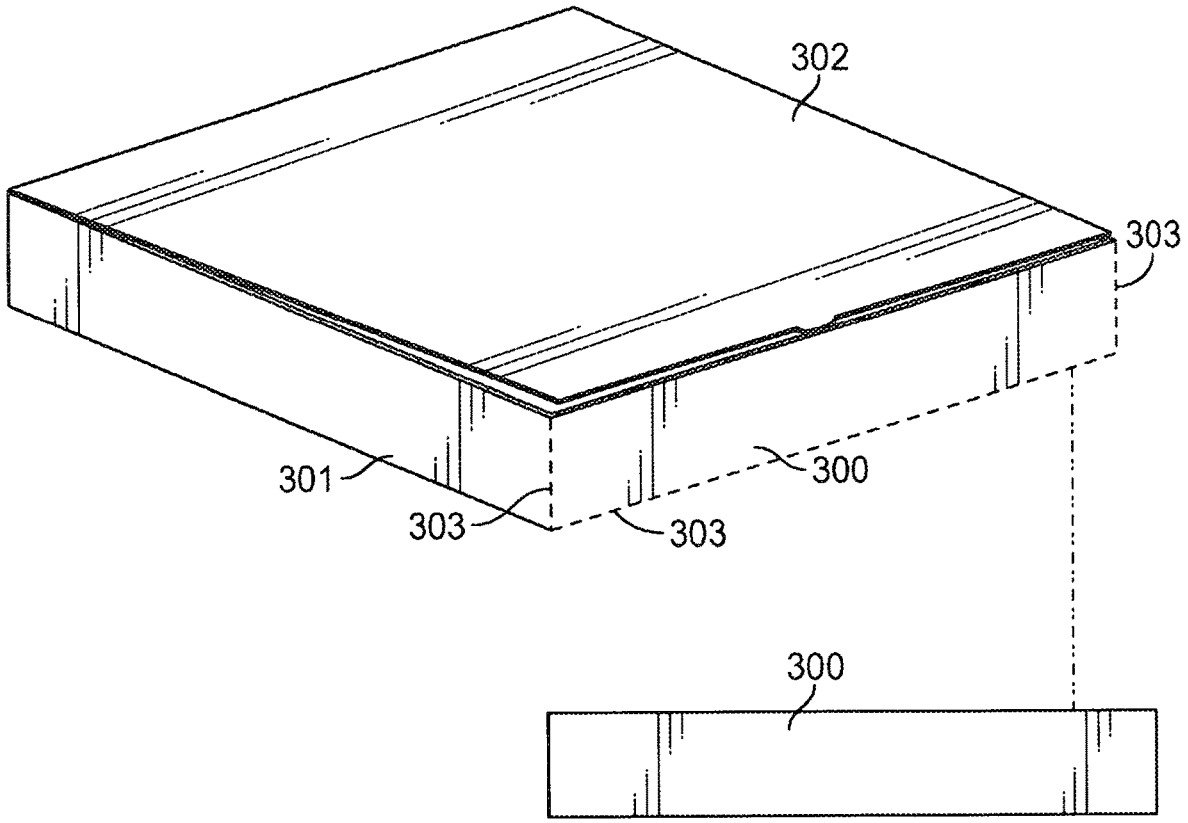
FIG. 30 is a front upper left perspective exploded view of an embodiment, in one form, of a box incorporating a flat blank that can be used to form a primitive embodiment of a serving utensil.

FIG. 30 illustrates another embodiment, in one form, of a pattern for creating a disposable serving utensil that can be punched out of an incised sheet of bendable material that comprises product packaging. FIG. 30 depicts a primitive embodiment (300) and shows the pattern to make the primitive embodiment from a box. The primitive embodiment and the box from which it can be punched out are comprised of a primitive embodiment (300) that is bounded by either or both an open top (as shown in FIG. 30) and incised edges (303), as well as a plurality of sides (301) and a plurality of planar coverings (302).

FIG. 30 further shows how to create the primitive embodiment from the box. The incised edges (303) allow the primitive embodiment (300) to be easily removed from the box. The primitive embodiment can then be used to cut the contents of the box (i.e. to cut a pizza in the case of FIG. 30), as a spatula to serve the food in the box, or both. The primitive embodiment can then either be disposed of or kept for further use, as desired. The effect of removing the primitive embodiment from the box will also allow the box to be more easily broken down for disposal or recycling.

It is also possible to create primitive embodiments from a plurality of sides (301). Such embodiments are claimed by this application, even though not illustrated in the drawings.

Ninth Exemplary Embodiment

Figure 31:
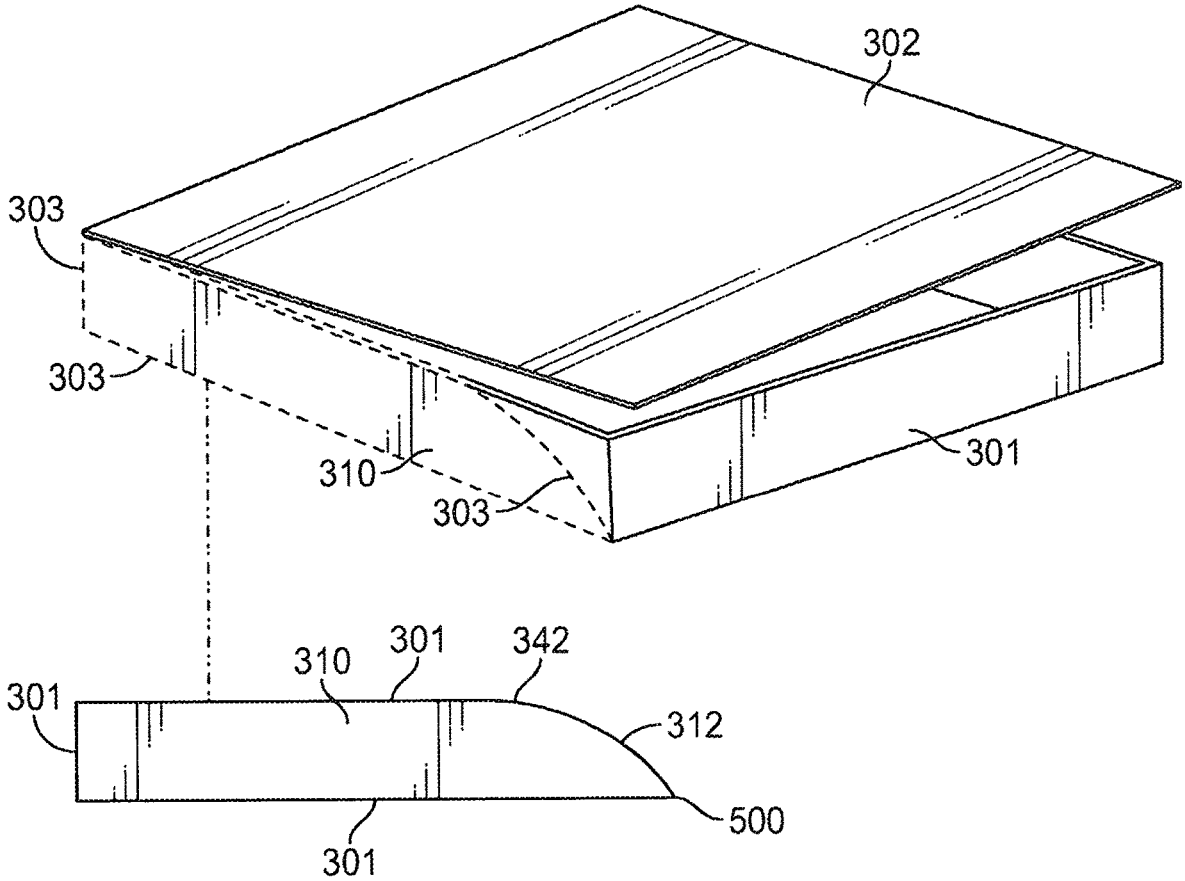
FIG. 31 is a front upper left perspective exploded view of an embodiment, in one form, of a box incorporating a flat blank that can be used to form a curved blade knife embodiment of a serving utensil.

FIG. 31 illustrates another embodiment, in one form, of a pattern for creating a disposable serving utensil that can be punched out of an incised sheet of bendable material that comprises product packaging. FIG. 31 depicts a curved blade knife embodiment (310) and shows the pattern to make the curved blade knife embodiment from a box. The curved blade knife embodiment and the box from which it can be punched out are comprised of a curved blade knife embodiment (310) that contains at least one curved cutting surface (312), that is bounded by either or both an open top (as shown in FIG. 30) and incised edges (303), as well as a plurality of box sides (301) and a plurality of planar coverings (302).

The curved blade knife embodiment illustrated in FIG. 31 is further partially comprised of a plurality of box sides (301); a left side first inflection point (342); and a curved cutting surface (312) that extends from the left side first inflection point (342) to a leading point of the utensil (500).

FIG. 31 further shows how to create the curved blade knife embodiment from the box. The incised edges (303) allow the curved blade knife embodiment (310) to be easily removed from the box. The curved blade knife embodiment can then be used to cut the contents of the box (i.e. to cut a pizza in the case of FIG. 31), as a spatula to serve the food in the box, or both. The curved blade knife embodiment can then either be disposed of or kept for further use, as desired. The effect of removing the curved blade knife embodiment from the box will also allow the box to be more easily broken down for disposal or recycling.

It is also possible to create curved blade knife embodiments from a plurality of sides (301). Such embodiments are claimed by this application, even though not illustrated in the drawings.

Tenth Exemplary Embodiment

Figure 32:
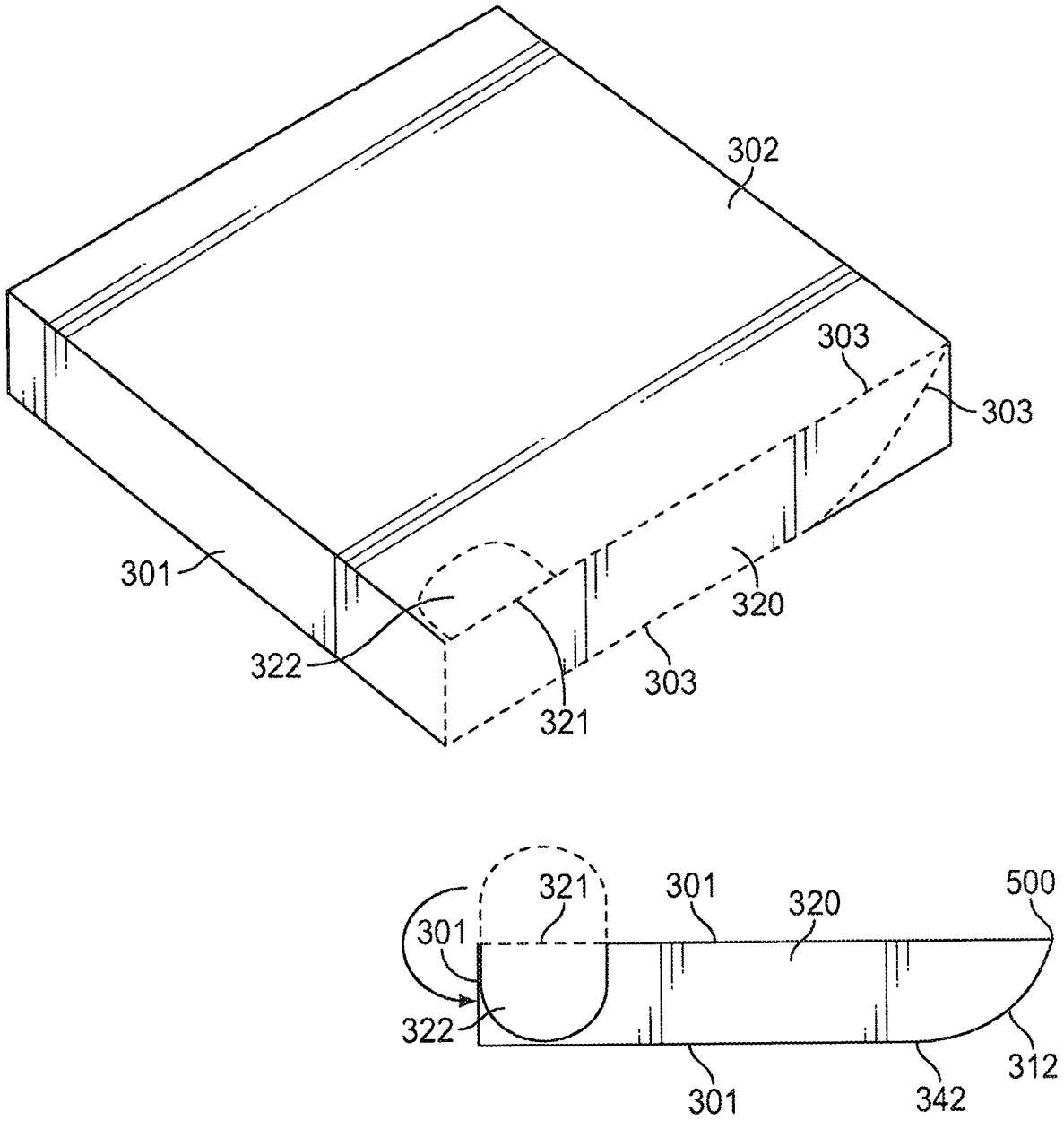
FIG. 32 is a front upper left perspective exploded view of an embodiment, in one form, of a box incorporating a flat blank that can be used to form a pizza machete embodiment of a serving utensil.

FIG. 32 illustrates another embodiment, in one form, of a pattern for creating a disposable serving utensil that can be punched out of an incised sheet of bendable material that comprises product packaging. FIG. 32 depicts a pizza machete embodiment (320) and shows the pattern to make the pizza machete embodiment from a box. The pizza machete embodiment and the box from which it can be punched out are comprised of a pizza machete embodiment (320) that contains at least one folding handle (322), at least one curved cutting surface (312), that is bounded by either or both an open top (as shown in FIG. 30) and incised edges (303), as well as a plurality of sides (301) and a plurality of planar coverings (302).

FIG. 32 further shows how to create the pizza machete embodiment from the box. The incised edges (303) allow the pizza machete embodiment (320) to be easily removed from the box. A folding handle (322) can then be folded down across an incised edge (321) to make the handle stronger, more robust and easier to grip, as shown in FIG. 32. The pizza machete embodiment can then be used to cut the contents of the box (i.e. to cut a pizza in the case of FIG. 32), as a spatula to serve the food in the box, or both. The pizza machete embodiment can then either be disposed of or kept for further use, as desired. The effect of removing the pizza machete embodiment from the box will also allow the box to be more easily broken down for disposal or recycling.

The pizza machete embodiment illustrated in FIG. 32 is further partially comprised of a plurality of box sides (301); a left side first inflection point (342); and a curved cutting surface (312) that extends from the left side first inflection point (342) to a leading point of the utensil (500).

It is also possible to create pizza machete embodiments from a plurality of sides (301). Such embodiments are claimed by this application, even though not illustrated in the drawings.

Eleventh Exemplary Embodiment

Figure 33:
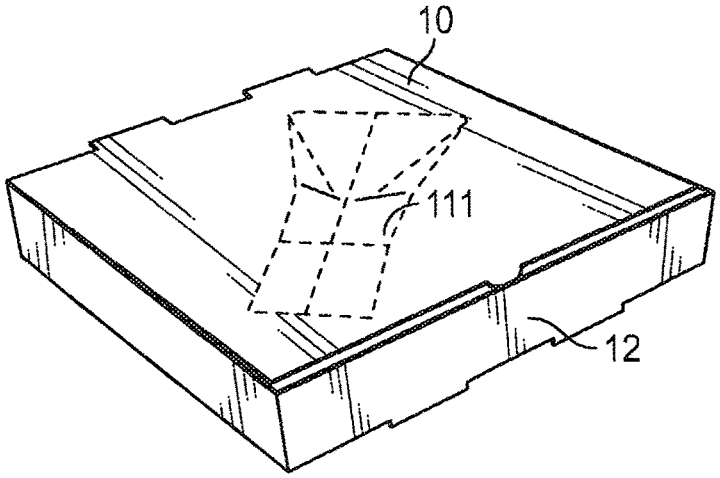
FIG. 33 is a front upper left perspective of an embodiment, in one form, of a pizza box lid and blank that can be used to form a squeeze-only blunt embodiment of a disposable serving utensil.

FIG. 33 illustrates an embodiment, in one form, of a foldable and bendable pattern for creating a serving utensil that can be punched out of an incised sheet of bendable material that comprises product packaging. FIG. 33 depicts a squeeze-only blunt embodiment (111) of a disposable serving utensil in packaging which is a pizza delivery box, that contains a pizza box lid and blank (10) and box front (12). However, other forms of packaging could also be used without departing from the disclosure as claimed, including, but not limited to, a cake box lid [container lid and blank, (40)] as shown in FIGS. 11 and 43 and a sheet of bendable material that is configured to also be used as a support for a product packaging lid as shown in FIG. 6 [lid support and blank, (41)].

Figure 34:
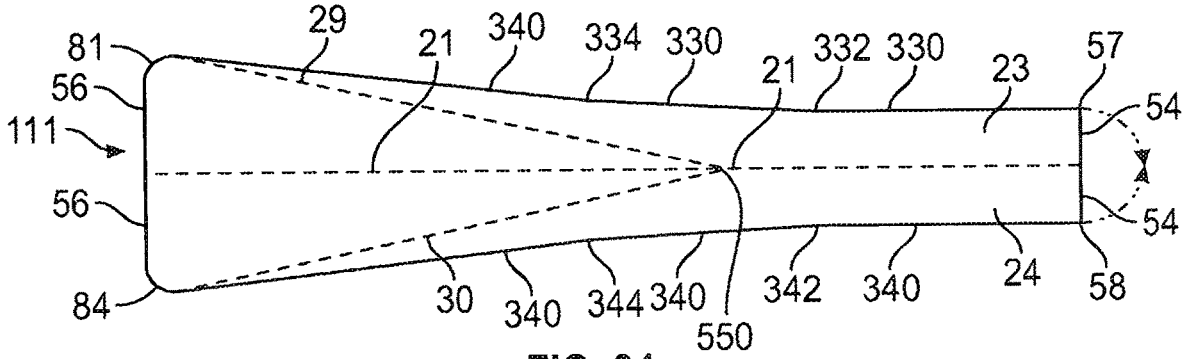
FIG. 34 is a top plan of an embodiment, in one form, of a foldable and bendable pattern for creating a squeeze-only blunt embodiment of a serving utensil, and of the process for forming the squeeze-only blunt embodiment for use.

FIG. 34 shows an embodiment, in one form, of a flat blank that can be used to form a squeeze-only blunt embodiment of a disposable serving utensil (111). The squeeze-only blunt embodiment of a disposable serving utensil disclosed in FIG. 34 is partially comprised of an incised center crease line (21) that is designed to make it easy for the flexible bendable material of which the flat blank is composed to crease; a right folding handle (23); a left folding handle (24); a right incised flex line (29); a left incised flex line (30); and a central focus point (550) through which the incised center crease line passes and which is an end point of both the right incised line and the left incised line.

The Eleventh Exemplary Embodiment illustrated in FIG. 34 is further partially comprised of a short end (54) that extends from a right corner (57) to a left corner (58); a longer end (56) that extends from a a right side dull point (81) to a left side dull point (84); a left side (340) that extends from the left corner (58) through a left side first inflection point (342) and a left side second inflection point (344) to the left side dull point (84); a right side (330) that extends from the right corner (57) through a right side first inflection point (332); and a right side second inflection point (334) to the right side dull point (81).

FIG. 34 depicts the first step in readying the squeeze-only blunt embodiment of a disposable serving utensil (111). That Figure shows that the right folding handle (23) is squeezed toward the left folding handle (24) across the incised center crease line (21).

Figure 35:
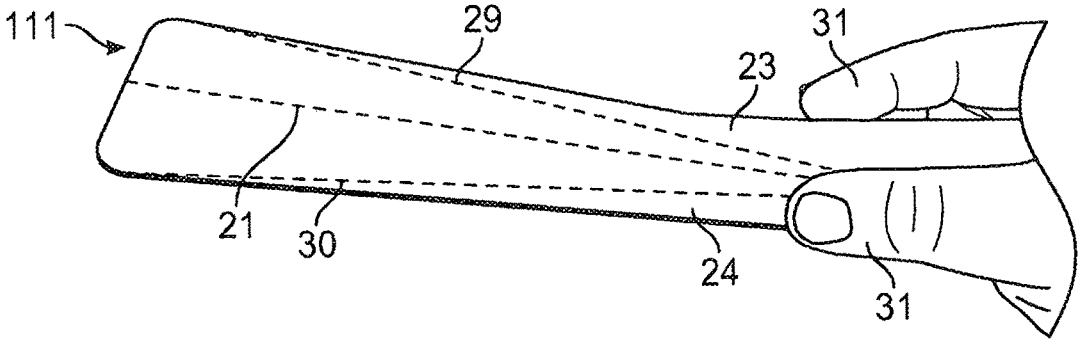
FIG. 35 is a top left perspective of an embodiment, in one form, of a squeeze-only blunt embodiment formed and ready for use.
Figure 36:
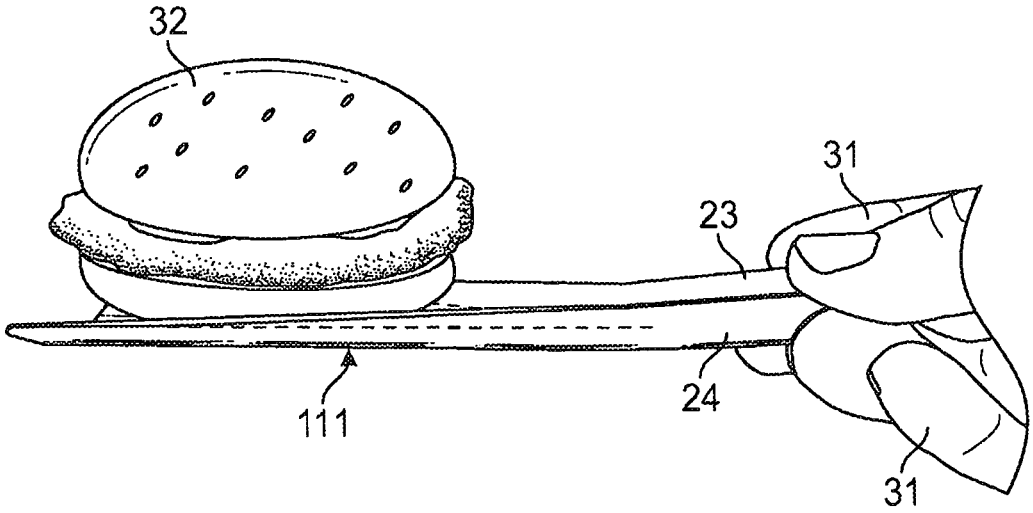
FIG. 36 is a left elevational view of an embodiment, in one form, of a squeeze-only blunt embodiment being used to serve a portion of food.

FIG. 35 depicts the user's fingers (31) pressing together the right folding handle (23) and the left folding handle (24) across the incised center crease line (21) in order to form the squeeze-only blunt embodiment. The squeeze-only blunt embodiment of a disposable serving utensil thus formed may then be used to slide underneath a portion of food (32) to be served and to serve that portion as desired, as shown by FIG. 36. The squeeze-only blunt embodiment of a disposable serving utensil may optionally be disposed of after use or may be kept for later additional uses if desired.

Twelfth Exemplary Embodiment

Figure 37:
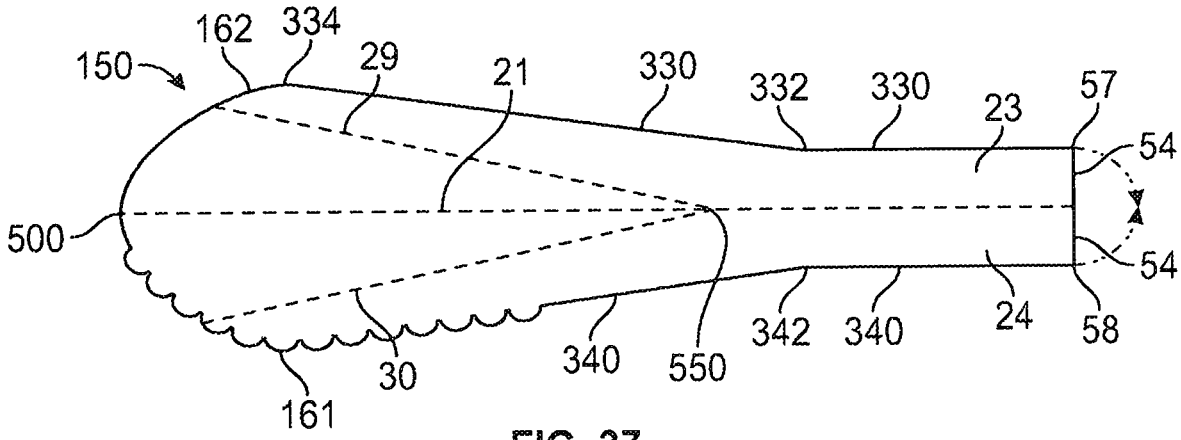
FIG. 37 is a top plan of an embodiment, in one form, of a foldable and bendable pattern for creating a squeeze-only semi-serrated embodiment of a serving utensil, and of the process for forming the squeeze-only semi-serrated embodiment for use.

FIG. 37 shows an embodiment, in one form, of a flat blank that can be used to form a squeeze-only semi-serrated embodiment (150) of a disposable serving utensil. The squeeze-only semi-serrated embodiment of a disposable serving utensil disclosed in FIG. 37 is partially comprised of an incised center crease line (21) that is designed to make it easy for the flexible bendable material of which the flat blank is composed to crease; a right folding handle (23); a left folding handle (24); a right incised flex line (29); a left incised flex line (30); curved serrated edge (161); a central focus point (550) and a curved non-serrated edge (162).

The Twelfth Exemplary Embodiment illustrated in FIG. 37 is further partially comprised of a short end (54) that extends from a right corner (57) to a left corner (58); a left side (340) that extends from the left corner (58) through a left side first inflection point (342) to a curved serrated edge (161); the curved serrated edge (161) extends from the left side (340) to a leading point of the utensil (500); a right side (330) that extends from the right corner (57) through a right side first inflection point (332) to a right side second inflection point (334); and a curved non-serrated edge (162) that extends from the right side second inflection point (334) to the leading point of the utensil (500).

FIG. 37 further shows how to form the squeeze-only semi-serrated embodiment (150) of a disposable serving utensil for use. That Figure shows that the right folding handle (23) is squeezed toward the left folding handle (24) across the incised center crease line (21).

Figure 38:
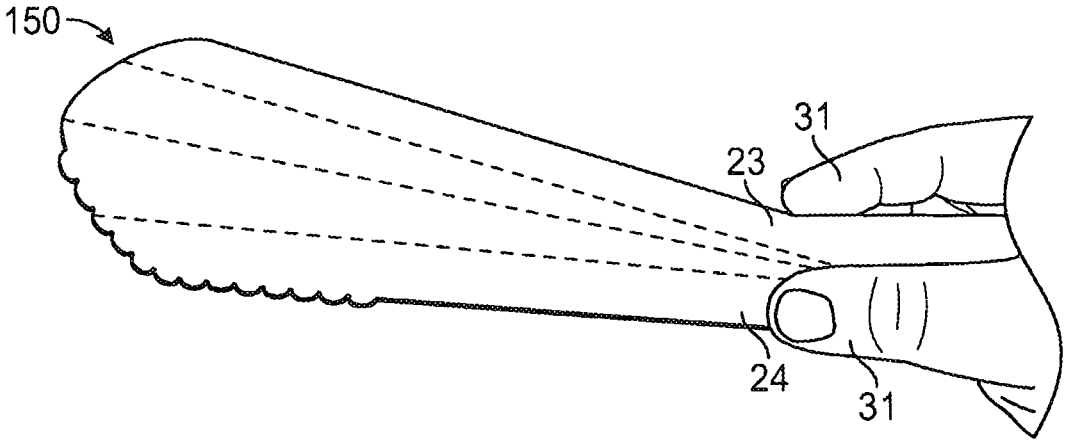
FIG. 38 is a top left perspective of an embodiment, in one form, of a squeeze-only semi-serrated embodiment formed and ready for use.
Figure 39:
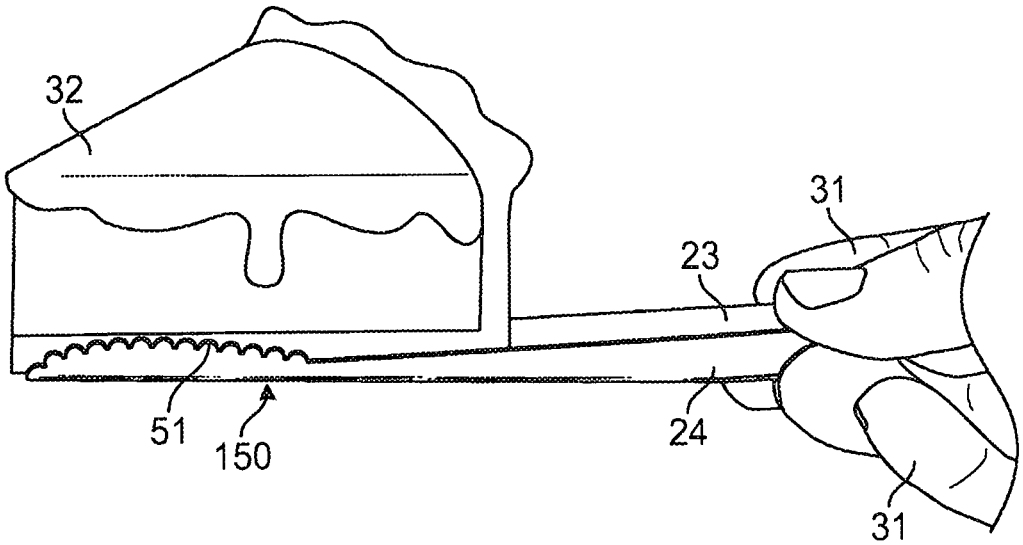
FIG. 39 is a left elevational view of an embodiment, in one form, of a squeeze-only semi-serrated embodiment being used to serve a portion of food.

FIG. 38 depicts the user's fingers (31) pressing together the right folding handle (23) and the left folding handle (24) across the incised center crease line (21) in order to form the squeeze-only blunt embodiment. The squeeze-only blunt embodiment of a disposable serving utensil thus formed may then be used to slide underneath a portion of food (32) to be served and to serve that portion as desired, as shown by FIG. 39. The squeeze-only blunt embodiment of a disposable serving utensil may optionally be disposed of after use or may be kept for later additional uses if desired.

Thirteenth Exemplary Embodiment

Figure 40:
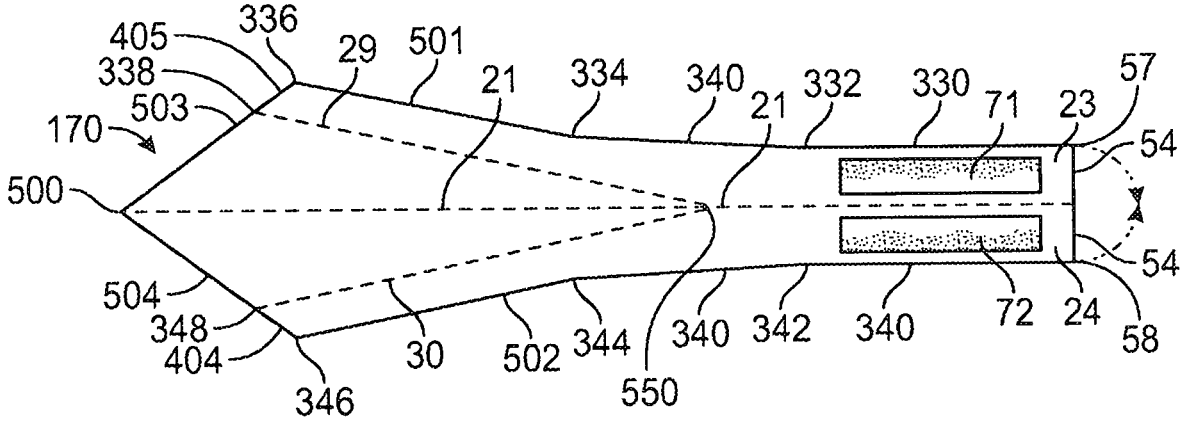
FIG. 40 is top plan of an embodiment, in one form, of a foldable and bendable pattern for creating a squeeze-only pointed non-serrated embodiment of a serving utensil, and of the process for forming the squeeze-only pointed non-serrated embodiment for use.

FIG. 40 shows an embodiment, in one form, of a flat blank that can be used to form a squeeze-only pointed non-serrated embodiment (170) of a disposable serving utensil. The squeeze-only pointed non-serrated embodiment of a disposable serving utensil disclosed in FIG. 40 is partially comprised of an incised center crease line (21) that is designed to make it easy for the flexible bendable material of which the flat blank is composed to crease; a right folding handle (23) that contains a right handle adhesive (71); a left folding handle (24) that contains a left handle adhesive (72); a right incised flex line (29); a left incised flex line (30) and a central focus point (550) through which the incised center crease line (21) passes and from which both the right incised flex line (29) and the left incised flex line (30) originate. The left handle adhesive and the right handle adhesive are preferably located only on the top sides of each handle.

The Thirteenth Exemplary Embodiment illustrated in FIG. 40 is further partially comprised of a short end (54) that extends from a right corner (57) to a left corner (58); a left side (340) that extends from the left corner (58) through a left side first inflection point (342) to a left side second inflection point (344); a left trailing non-serrated edge (502) that extends from the left side second inflection point (344) to a left side third inflection point (346); a left incline (404) that extends from the left side third inflection point (346) to a left side fourth inflection point (348); a left leading non-serrated edge (504) that extends from the left side fourth inflection point (348) to a leading point of the utensil (500); a right side (330) that extends from the right corner (57) through a right side first inflection point (332) to a right side second inflection point (334); a right trailing non-serrated edge (501) that extends from the right side second inflection point (334) to a right side third inflection point (336); a right incline (405) that extends from the right side third inflection point (336) to a right side fourth inflection point (338); and a right leading non-serrated edge (503) that extends from the right side fourth inflection point (338) to a leading point of the utensil (500).

FIG. 40 further shows how to form the squeeze-only pointed non-serrated embodiment (170) of a disposable serving utensil for use. That Figure shows that the right folding handle (23) is squeezed toward the left folding handle (24) across the incised center crease line (21), thus causing the right handle adhesive (71) to make contact with the left handle adhesive (72) and thereby causing the right folding handle (23) to stick to the left folding handle (24).

Figure 41:
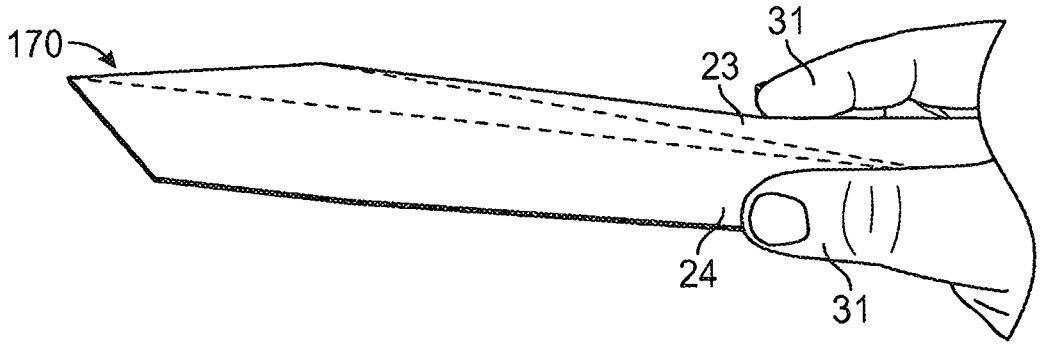
FIG. 41 is a bottom left elevational view of a squeeze-only pointed non-serrated embodiment of a serving utensil, formed and ready for use.
Figure 42:
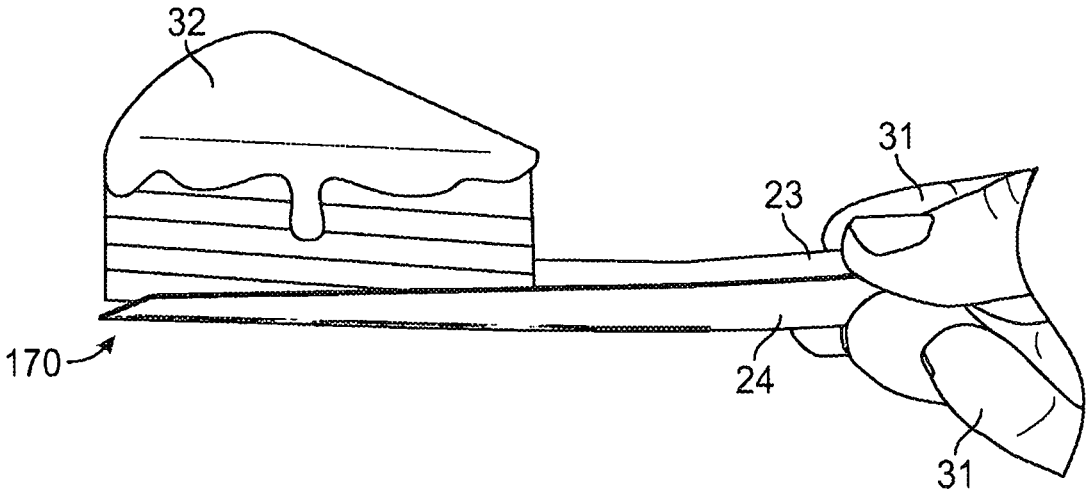
FIG. 42 is a left elevational view of an embodiment, in one form, of a squeeze-only pointed non-serrated embodiment being used to serve a portion of food.

FIG. 41 depicts the user's fingers (31) pressing together the right folding handle (23) and the left folding handle (24) across the incised center crease line (21) in a formed squeeze-only pointed non-serrated embodiment. The squeeze-only pointed non-serrated embodiment of a disposable serving utensil thus formed may then be used to slide underneath a portion of food (32) to be served and to serve that portion as desired, as shown by FIG. 42. The squeeze-only pointed non-serrated embodiment of a disposable serving utensil may optionally be disposed of after use or may be kept for later additional uses if desired.

Fourteenth Exemplary Embodiment

FIG. 43 illustrates still another embodiment, in one form, of a foldable and bendable pattern for creating a disposable serving utensil that can be punched out of an incised sheet of bendable material that comprises product packaging. FIG. 43 depicts a squeeze-only non-blunt semi-serrated embodiment (160) circumscribed by an incised punch out line (43) in a container lid and blank (40) in a box that contains a food item (48), shown as a cake in FIG. 43. The incised punch out line (43) allows the squeeze-only non-blunt semi-serrated embodiment (160) to be punched out of the lid support and blank (40) without tearing the flexible and bendable material from which the lid support and blank is formed.

Figure 44:
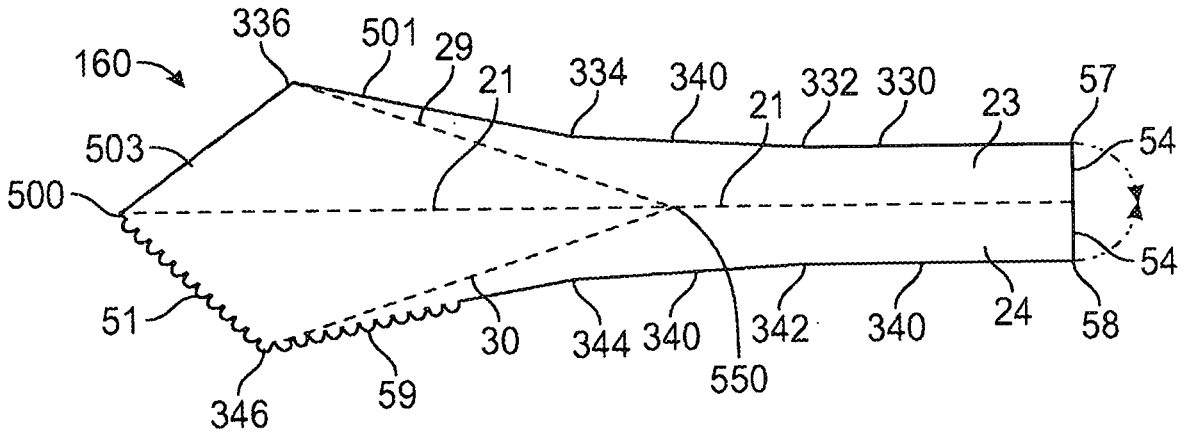
FIG. 44 is a top plan of an embodiment, in one form, of a foldable and bendable pattern for creating a squeeze-only non-blunt semi-serrated embodiment of a serving utensil, and of the process for forming the squeeze-only non-blunt semi-serrated embodiment for use.

FIG. 44 shows the pattern to make the squeeze-only non-blunt semi-serrated embodiment (160). This embodiment is partially comprised of an incised center crease line (21); a right folding handle (23); a left folding handle (24); a right incised flex line (29); a left incised flex line (30) and a central focus point (550) through which the incised center crease line (21) passes and from which both the right incised flex line (29) and the left incised flex line (30) originate.

The Fourteenth Exemplary Embodiment illustrated in FIG. 44 is further partially comprised of one short end (54) that extends from a right corner (57) to a left corner (58); a left side (340) that extends from the left corner (58) to a left side second inflection point (344) and which is approximately bisected by a left side first inflection point (342); a trailing serrated edge (59) that extends from the left side second inflection point (344) to a left side third inflection point (346); a leading serrated edge (51) that extends from the left side third inflection point (346) to a leading point of the utensil (500); a right side (330) that extends from the right corner (57) to a right side second inflection point (334) and which is approximately bisected by a right side first inflection point (332); a right trailing non-serrated edge (501) that extends from the right side second inflection point (334) to a right side third inflection point (336); and a right leading non-serrated edge (503) that extends from the right side third inflection point (336) to the leading point of the utensil (500).

Figure 45:
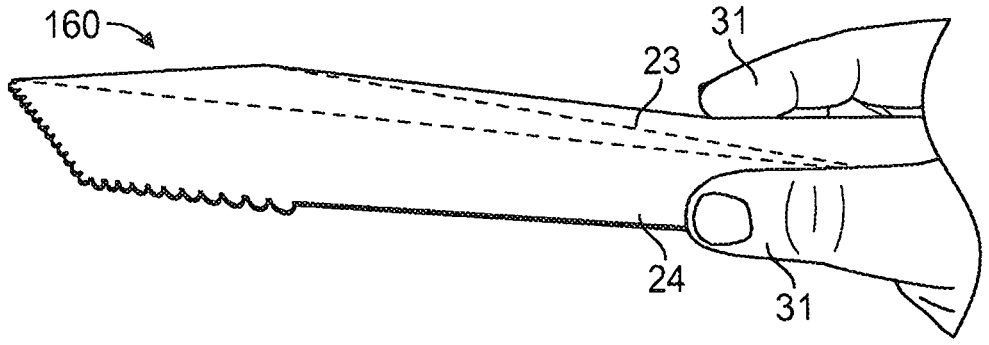
FIG. 45 is a bottom left elevational view of a squeeze-only non-blunt semi-serrated embodiment of a serving utensil, formed and ready for use.
Figure 46:
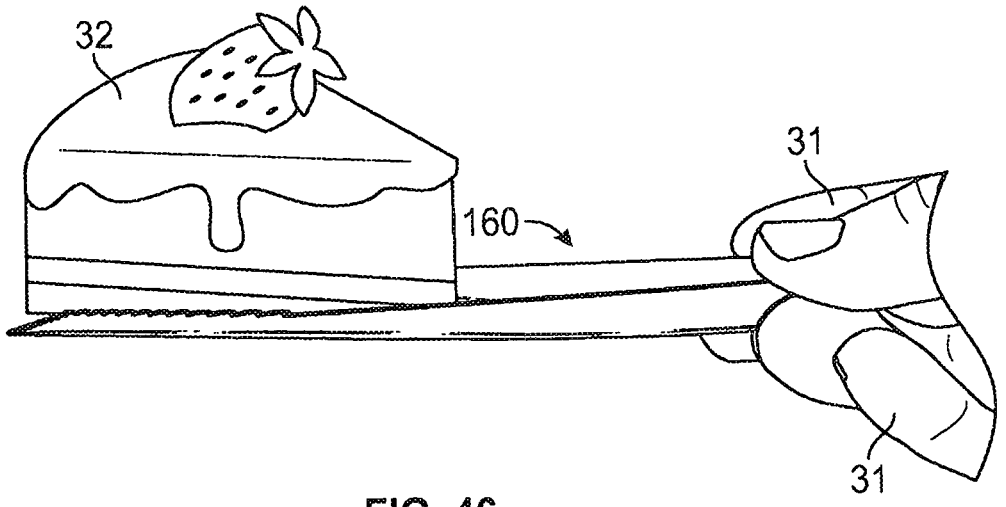
FIG. 46 is a left elevational view of an embodiment, in one form, of a squeeze-only non-blunt semi-serrated embodiment being used to serve a portion of food.

The right folding handle and the left folding handle fold in the direction indicated by the arrows in FIG. 44, with the right folding handle folding across the incised center crease line (21) onto the left folding handle (24). FIG. 45 shows that once this has been done, the user's fingers (31) are used to squeeze the right folding handle (23) and the left folding handle (24) upward and together to form the squeeze-only non-blunt semi-serrated embodiment (160). The squeeze-only non-blunt semi-serrated embodiment can then be used to pick up a portion of food (32) to be served, as in FIG. 46 where the food item is shown as a piece of cake.

Other Possible Variants of the Disclosed Embodiments

Other possible variants of the disclosed embodiments can be created wherein the bendable material (from which the disclosed embodiments can be formed) is made of materials that are either or both:

A. Resistant to liquids, such as hydrophobic paper or cardboard that has self-assembled silicon-oxide nanoparticles with functional silane groups and fluorocarbonated compounds linked directly to cellulose fibers of at least one of the surfaces thereof, with a Cobb value of 8 to 25 g/m2 and water contact angles of 100 to 140 degrees [such as that taught by Marroquin in EP Application 2837736A1 (which is hereby incorporated by reference)] and similar; or B. coated with materials that are resistant to liquids, including, but not limited to, waterproof film laminated to cardboard, polyethylene, waxes, fluor-derivatives, biopolymers, such as polysaccharides, proteins, lipids and polyesters, biopolymer nanoparticles and nanofillers such as nanoclay and nanocellulose.

All such embodiments are claimed by this application.

Other additional embodiments are also possible as to each of the Exemplary Embodiments previously described. All such embodiments are claimed by this application.

Wherever reference is made in this disclosure to separating any portion of the sheet of bendable material from any other portion of the sheet of bendable material along any incised line or any score and fold mark, the separation may be achieved by bending the bendable material back and forth until it breaks along the incised line or the score and fold mark, by tearing the material down the incised line or the score and fold mark, by cutting the bendable material along the incised line or the score and fold mark with any sort of tool or by any other means of separating the bendable material along the incised line or the score and fold mark; all such methods of separation are claimed by this application.

Wherever incised lines are mentioned in this disclosure it is understood that all such incised lines are designed to make it easy for the flexible bendable material of which the flat blank is composed to crease.

In the event that any of the patent documents that are incorporated by reference herein define or use a term in a manner that is inconsistent with either the non-incorporated disclosure of the present application or with any of the other incorporated patent documents, the non-incorporated disclosure of the present application shall control with respect to the present application, and the term or terms as used in an incorporated patent document shall only control with respect to the document in which the term or terms are defined or used.

The various disclosed elements of apparatuses and steps of methods disclosed herein are not required as to all apparatuses and methods set forth in the present disclosure, and the present disclosure includes all novel and non-obvious combinations and sub-combinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein; such inventive subject matter may find utility in future apparatuses and/or methods and may be claimed through amendment of the present claims or presentation of new claims in this or a related application.

The specific alternatives, embodiments, and methods thereof as disclosed and illustrated herein are not to be considered in a limiting sense, as numerous variations are possible. The present disclosure includes all novel and non-obvious combinations and sub-combinations of the various elements, features, functions, properties, methods, and/or steps disclosed herein. The following claims particularly point out certain combinations and sub-combinations that are directed to one of the disclosed inventions and are novel and non-obvious. Inventions embodied in other combinations and sub-combinations of features, functions, elements, properties, methods, and/or steps may be claimed through amendment of the present claims or presentation of new claims in this or a related application. Such amended or new claims, whether they are directed to a different invention or directed to the same invention, whether different, broader, narrower, or equal in scope to the original claims, are also within the subject matter of the present disclosure.

While the description of several embodiments has been presented and while the exemplary embodiments are described in detail, it is not the intention of the applicant to restrict or in any way limit the scope of the appended claims to such detail. Applicant intends by this application to cover all possible embodiments that are described by the claims, even if such embodiments are not specifically shown or described in the Figures or in the Description of the Embodiments. That is, the claims in their broader aspects are therefore not limited to any of the specific details or to any of the representative apparatus and illustrative examples shown and described in the Figures and the specification. Accordingly, departures may be made from such details without departing from the spirit or scope of applicant's general concept as claimed.

INDUSTRIAL APPLICABILITY

The disclosed embodiments and the methods associated therewith have applicability to any area of food service and food packaging and are particularly applicable to pizza boxes and utensils for serving pizza. They are also applicable to any situation where it would be convenient, desirable or cost effective to dispose of the serving utensils after serving food.

Reference Signs List

| Reference Number | Description |
|---|---|
| 10 | pizza box lid and blank |
| 11 | blunt embodiment of a disposable serving utensil |
| 12 | box front |

-continued

Reference Signs List

| Reference Number | Description |
|---|---|
| 21 | incised center crease line |
| 22 | center handle cut |
| 23 | right folding handle |
| 24 | left folding handle |
| 25 | right handle cut |
| 26 | left handle cut |
| 27 | right handle angling cut |
| 28 | left handle angling cut |
| 29 | right incised flex line |
| 30 | left incised flex line |
| 31 | user's fingers |
| 32 | portion of food |
| 33 | incised fold line for support pylon |
| 34 | cut line for pylon support |
| 35 | box lid with viewing portal |
| 40 | container lid and blank |
| 41 | lid support and blank |
| 42 | support pylon |
| 43 | incised punch out line |
| 44 | pie-shaped embodiment |
| 45 | right embankment |
| 46 | left embankment |
| 47 | an underlying surface |
| 48 | a food item |
| 50 | semi-serrated embodiment |
| 51 | leading serrated edge |
| 52 | leading non-serrated edge |
| 54 | short end |
| 56 | longer end |
| 57 | right corner |
| 58 | left corner |
| 59 | trailing serrated edge |
| 60 | non-blunt semi-serrated embodiment |
| 70 | pointed non-serrated embodiment |
| 71 | right handle adhesive |
| 72 | left handle adhesive |
| 73 | incised handle fold line |
| 80 | dull pointed non-serrated embodiment |
| 81 | right side dull point |
| 82 | exterior tab |
| 83 | tab slot |
| 84 | left side dull point |
| 90 | second pointed non-serrated embodiment |
| 91 | right tab |
| 92 | right interior insertion slot |
| 93 | left tab |
| 94 | left interior insertion slot |
| 111 | squeeze-only blunt embodiment |
| 150 | squeeze-only semi-serrated embodiment |
| 160 | squeeze-only non-blunt semi-serrated embodiment |
| 161 | curved serrated edge |
| 162 | curved non-serrated edge |
| 170 | squeeze-only pointed non-serrated embodiment |
| 270 | incised right handle flex line |
| 271 | incised left handle flex line |
| 300 | primitive embodiment |
| 301 | box side |
| 302 | planar covering |
| 303 | incised edge |
| 310 | curved blade knife embodiment |
| 312 | curved cutting surface |
| 320 | pizza machete embodiment |
| 321 | incised folding edge |
| 322 | folding handle |
| 330 | right side |
| 332 | right side first inflection point |
| 334 | right side second inflection point |
| 336 | right side third inflection point |
| 338 | right side fourth inflection point |
| 340 | left side |
| 342 | left side first inflection point |
| 344 | left side second inflection point |
| 346 | left side third inflection point |
| 348 | left side fourth inflection point |
| 400 | left side of the handle |

-continued

| Reference Signs List | |
|---|---|
| Reference Number | Description |
| 401 | right side of the handle |
| 402 | left rear piece |
| 403 | right rear piece |
| 404 | left incline |
| 405 | right incline |
| 406 | left side trailing edge |
| 407 | right side trailing edge |
| 408 | left side leading edge |
| 409 | right side leading edge |
| 500 | leading point of the utensil |
| 501 | right trailing non-serrated edge |
| 502 | left trailing non-serrated edge |
| 503 | right leading non-serrated edge |
| 504 | left leading non-serrated edge |
| 550 | central focus point |

CITATION LIST

Patent Literature

FR 9,409,367, Hamon—"LANGUETTE SPATULE ATTENANT A UN RECIPIENT"

U.S. Pat. No. 5,476,214, Fisk, Jr.—"PIZZA BOX WITH WEDGE-SHAPED BREAK-DOWN SPATULA-PLATES"

U.S. Pat. No. 6,905,065 B2, Holden—"AMBIDEXTROUS SECTIONAL PIZZA BOX"

EP 3178748A1, Rubino—"PIZZA BOX"

The invention claimed is:

1. A disposable serving utensil apparatus comprised of bendable material that can be incised, scored and folded and that can be created out of boxes, containers or a blank of bendable material, said apparatus comprising:

a short end (54);

a center handle through cut (22) that extends from the short end to a right handle through cut (25);

one longer end (56) that is approximately parallel to the one short end;

one center perforated crease fold (21) that extends from the longer end to said right handle through cut (25);

a right side and a left side that extend from the one short end to the one longer end;

are approximately mirror images of each other along both the center handle through cut (22) and the center perforated crease fold (21);

a right folding handle flap (23), that extends from the short end to a right handle through cut;

a left folding handle flap (24), that extends from the short end to a left handle through cut;

said right folding handle flap (23) and said left folding handle flap (24) being oriented in a face-to-face relationship;

said right handle through cut (25) that extends orthogonally from the junction of the center perforated crease fold (21) and the center handle through cut to approximately half the distance to the right side;

said left handle through cut (26) that extends orthogonally from the left side approximately half the distance to the junction of the center perforated crease fold and the center handle through cut;

a right handle angling cut (27) that has one end that is proximally closer to both the center perforated crease fold and to the short end;

has one end that is proximally closer to both the right side and to the longer end;

that is capable of receiving the portion of the short end that is part of the right folding handle flap (23);

a left handle angling cut (28) that has one end that is proximally closer to both the center perforated crease fold and to the short end;

has one end that is proximally closer to both the left side and to the longer end;

is capable of receiving the portion of the short end that is part of the left folding handle flap (24);

a right perforated crease fold (29) that extends from the right handle angling cut to approximately the junction of the right side with the longer end; and a left perforated crease fold (30) that extends from the left handle angling cut to approximately the junction of the left side with the longer end.

2. A box for serving food, such as pizza or cake, comprising a plurality of box sides;

an approximately planar covering;

an approximately planar bottom;

and at least one of the apparatuses of claim 1.

3. The apparatus of claim 1, in which any portion of the flat sheet of bendable material is formed of materials that are resistant to liquids, such as hydrophobic paper or cardboard that has self-assembled silicon-oxide nanoparticles with functional silane groups and fluorocarbonated compounds linked directly to cellulose fibers of at least one of the surfaces thereof, with a Cobb value of 8 to 25 g/m2 and water contact angles of 100 to 140 degrees.

4. The apparatus of claim 1, in which any portion of the flat sheet of bendable material is coated with materials that are resistant to liquids, including, but not limited to, waterproof film laminated to cardboard, polyethylene, waxes, fluor-derivatives, biopolymers, such as polysaccharides, proteins, lipids and polyesters, biopolymer nanoparticles and nanofillers, such as nanoclay and nanocellulose.

5. A disposable serving utensil apparatus comprised of bendable material that can be incised, scored and folded and that can be created out of boxes, containers or a blank of bendable material, said apparatus comprising:

a box for serving food, such as pizza or cake, comprising a plurality of box sides;

an approximately planar covering;

an approximately planar bottom;

a pizza machete embedded in some or all of one or more of the box sides;

an approximately planar covering;

an approximately planar bottom;

comprising a plurality of incised edges circumscribing a folding handle comprising two corners of a box side; part of a box side connecting the two corners of a box side; two approximately parallel box sides, one short and one longer; a folding handle flap that folds across an incised folding edge; and a blade comprising a cutting surface spanning the distance between the short parallel box side and the longer parallel box side.

6. A disposable serving utensil apparatus comprised of bendable material that can be incised, scored and folded and that can be created out of boxes, containers or a blank of bendable material, said apparatus comprising:

a short end (54);

one longer end (56) that is approximately parallel to the one short end;

one incised center crease line center perforated crease fold (21) that extends from the longer end to the short end and which passes through a central focus point (550);

a right side and a left side that extend from the one short end to the one longer end;

are approximately mirror images of each other along the center perforated crease fold (21);

a right perforated crease fold (29) that extends from the central focus point (550) to approximately the right side dull point (81); and a left perforated crease fold (30) that extends from the central focus point (550) to approximately the right side dull point (84).

* * * * *